US011412336B2

(12) United States Patent
Laitinen et al.

(10) Patent No.: US 11,412,336 B2
(45) Date of Patent: Aug. 9, 2022

(54) SIGNALLING OF SPATIAL AUDIO PARAMETERS

(71) Applicant: Nokia Technologies Oy, Espoo (FI)

(72) Inventors: Mikko-Ville Laitinen, Espoo (FI); Lasse Laaksonen, Tampere (FI); Juha Vilkamo, Helsinki (FI); Tapani Pihlajakuja, Vantaa (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 17/058,742

(22) PCT Filed: May 29, 2019

(86) PCT No.: PCT/FI2019/050412

§ 371 (c)(1),
(2) Date: Nov. 25, 2020

(87) PCT Pub. No.: WO2019/229298

PCT Pub. Date: Dec. 5, 2019

(65) Prior Publication Data

US 2021/0219084 A1 Jul. 15, 2021

(30) Foreign Application Priority Data

May 31, 2018 (GB) ..... 1808930

(51) Int. Cl.
*H04S 3/02* (2006.01)
*G10L 19/008* (2013.01)
(Continued)

(52) U.S. Cl.
CPC ..... *H04S 3/02* (2013.01); *G10L 19/008* (2013.01); *H04R 5/02* (2013.01); *H04S 7/302* (2013.01); *H04S 2420/03* (2013.01)

(58) Field of Classification Search
CPC ..... G10L 19/008; G10L 19/167; G10L 25/06; H04S 2420/03; H04S 2400/03; H04S 2400/01; H04S 2420/01
(Continued)

(56) References Cited

U.S. PATENT DOCUMENTS 9,369,164 B2 6/2016 Kim
9,747,905 B2 8/2017 Pang
(Continued)

FOREIGN PATENT DOCUMENTS

EP 2560161 A1 2/2013
GB 2554446 A 4/2018
(Continued)

OTHER PUBLICATIONS

3GPP TSG-SA#98 meeting, Apr. 9-13, 2018, Kista, Sweden, Tdoc S4 (18)0462, "On spatial metadata for IVAS spatial audio input format", Nokia Corporation, 7 pgs.
(Continued)

*Primary Examiner* — Alexander Krzystan
(74) *Attorney, Agent, or Firm* — Harrington & Smith

(57) ABSTRACT

Apparatus including circuitry configured for: determining, for two or more speaker channel audio signals, at least one spatial audio parameter for providing spatial audio reproduction; determining between the two or more speaker channel audio signals at least one audio signal relationship parameter, the at least one audio signal relationship parameter being associated with at least one coherence parameter, in such a way that the at least one coherence parameter provides at least one interchannel coherence information for at least two frequency bands, to reproduce the two or more speaker channel audio signals based on the at least one
(Continued)

spatial audio parameter and the at least one audio signal relationship parameter; and transmitting using at least one determined value.

20 Claims, 20 Drawing Sheets

(51) Int. Cl.
*H04R 5/02* (2006.01)
*H04S 7/00* (2006.01)

(58) Field of Classification Search
USPC ..... 381/23, 19, 22, 12, 10
See application file for complete search history.

(56) References Cited

U.S. PATENT DOCUMENTS

| | | | | |
|---|---|---|---|---|
| 9,820,073 | B1 | 11/2017 | Foti | |
| 2005/0157883 | A1 | 7/2005 | Herre | 381/17 |
| 2006/0053018 | A1* | 3/2006 | Engdegard | H04S 5/00 704/500 |
| 2007/0002971 | A1* | 1/2007 | Purnhagen | G10L 19/008 375/316 |
| 2007/0127733 | A1* | 6/2007 | Henn | H04S 3/008 381/80 |
| 2007/0233293 | A1 | 10/2007 | Villemoes et al. | 700/94 |
| 2007/0258607 | A1 | 11/2007 | Purnhagen | 381/307 |
| 2009/0110203 | A1 | 4/2009 | Taleb | 381/17 |
| 2010/0169102 | A1 | 7/2010 | Samsudin et al. | |
| 2012/0082319 | A1* | 4/2012 | Jot | G10K 15/08 381/63 |
| 2012/0163606 | A1 | 6/2012 | Eronen | |
| 2013/0216047 | A1 | 8/2013 | Kuech et al. | 381/26 |
| 2013/0262130 | A1* | 10/2013 | Ragot | G10L 19/008 704/500 |
| 2014/0233762 | A1* | 8/2014 | Vilkamo | G10H 1/183 381/119 |
| 2015/0170657 | A1 | 6/2015 | Thompson et al. | |
| 2019/0066701 | A1* | 2/2019 | Fatus | G10L 19/008 |
| 2019/0156841 | A1* | 5/2019 | Fatus | G10L 19/008 |
| 2019/0394606 | A1 | 12/2019 | Tammi | |
| 2020/0045494 | A1* | 2/2020 | Liu | G10L 19/22 |
| 2021/0219084 | A1* | 7/2021 | Laitinen | G10L 19/008 |

FOREIGN PATENT DOCUMENTS

| | | | |
|---|---|---|---|
| JP | 2007531915 | A | 11/2007 |
| WO | WO 2005/101370 | A1 | 10/2005 |
| WO | WO 2005/101905 | A1 | 10/2005 |
| WO | WO 2008/032255 | A2 | 3/2008 |
| WO | WO 2008/046531 | A1 | 4/2008 |
| WO | WO 2008/100098 | A1 | 8/2008 |
| WO | WO 2010/080451 | A1 | 7/2010 |
| WO | WO-2017/153697 | A1 | 9/2017 |
| WO | WO-2019/086757 | A1 | 5/2019 |

OTHER PUBLICATIONS

Politis, Archontis, et al., "Enhancement of Ambisonic Binaural Reproduction Using Directional Audio Coding with Optimal Adaptive Mixing", 2017 IEEE Workshop on Applications of Signal Processing to Audio and Acoustics, Oct. 15-18, 2017, 2 pgs.

Politis, Archontis, et al., "Sector-Based Parametric Sound Field Reproduction in the Spherical Harmonic Domain", IEEE Journal of Selected Topics in Signal Processing, Jul. 14, 2015, 2 pgs.

Pulkki, Ville, "Virtual Sound Source Positioning Using Vector Base Amplitude Panning", © Audio Engineering Society, Inc. 1997, 11 pgs.

Ahrens Jens et al. "Two Physical Models for Spatially Extended Virtual Sound Sources" AES Convention 131; Oct. 2011, AES, New York, USA. Oct. 19, 2011.

3GPP TSG-SA4# 102 Meeting, Jan. 28-Feb. 1, 2019, Bruges, Belgium, TDoc S4 (19) 0121, "Proposal for MASA Format" Nokia Corporations, 10 pgs.

* cited by examiner

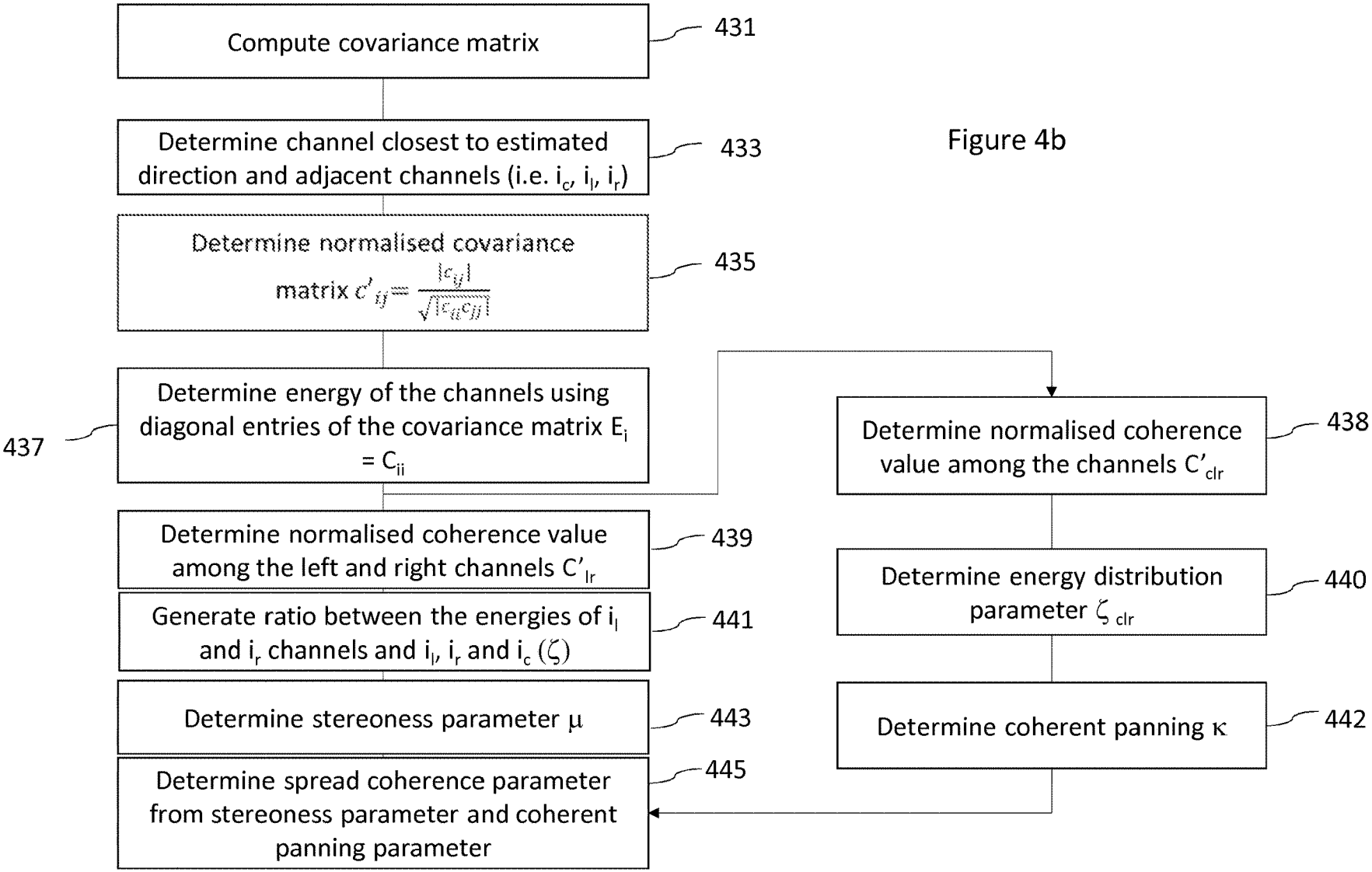
Figure 4b
431
Compute covariance matrix
433
Determine channel closest to estimated direction and adjacent channels (i.e. $i_c$, $i_l$, $i_r$)
435
Determine normalised covariance matrix $c'_{ij} = \frac{|c_{ij}|}{\sqrt{|c_{ii}c_{jj}|}}$
437
Determine energy of the channels using diagonal entries of the covariance matrix $E_i = C_{ii}$
438
Determine normalised coherence value among the channels $C'_{clr}$
439
Determine normalised coherence value among the left and right channels $C'_{lr}$
440
Determine energy distribution parameter $\zeta_{clr}$
441
Generate ratio between the energies of $i_l$ and $i_r$ channels and $i_l$, $i_r$ and $i_c$ ($\zeta$)
442
Determine coherent panning $\kappa$
443
Determine stereoness parameter $\mu$
445
Determine spread coherence parameter from stereoness parameter and coherent panning parameter

Figure 9a

| base | q-step3 | q-step2 | q-step1 | q-step0 | bits | | | | degrees |
|---|---|---|---|---|---|---|---|---|---|
| -90 | | | | 90 | | | | 0 | -90 |
| -90 | | | | 90 | | | | 1 | 0 |
| -90 | | | 45 | 90 | | | 1 | 0 | -45 |
| -90 | | | 45 | 90 | | | 1 | 1 | 45 |
| -90 | | 22,5 | 45 | 90 | | 1 | 0 | 0 | -67,5 |
| -90 | | 22,5 | 45 | 90 | | 1 | 0 | 1 | 22,5 |
| -90 | | 22,5 | 45 | 90 | | 1 | 1 | 0 | -22,5 |
| -90 | | 22,5 | 45 | 90 | | 1 | 1 | 1 | 67,5 |
| -90 | 11,25 | 22,5 | 45 | 90 | 1 | 0 | 0 | 0 | -78,75 |
| -90 | 11,25 | 22,5 | 45 | 90 | 1 | 0 | 0 | 1 | 11,25 |
| -90 | 11,25 | 22,5 | 45 | 90 | 1 | 0 | 1 | 0 | -33,75 |
| -90 | 11,25 | 22,5 | 45 | 90 | 1 | 0 | 1 | 1 | 56,25 |
| -90 | 11,25 | 22,5 | 45 | 90 | 1 | 1 | 0 | 0 | -56,25 |
| -90 | 11,25 | 22,5 | 45 | 90 | 1 | 1 | 0 | 1 | 33,75 |
| -90 | 11,25 | 22,5 | 45 | 90 | 1 | 1 | 1 | 0 | -11,25 |
| -90 | 11,25 | 22,5 | 45 | 90 | 1 | 1 | 1 | 1 | 78,75 |

Figure 9b

| base | emb1 | emb0 | q-step1 | q-step0 | bits | degrees | norm'd |
|---|---|---|---|---|---|---|---|
| -90 | | | 45 | 90 | 0 0 | -90 | -90 |
| -90 | | | 45 | 90 | 0 1 | 0 | 0 |
| -90 | | | 45 | 90 | 1 0 | -45 | -45 |
| -90 | | | 45 | 90 | 1 1 | 45 | 45 |
| -90 | | 15 | 45 | 90 | 0 0 0 | *-105* | 75 |
| -90 | | 15 | 45 | 90 | 0 0 1 | -15 | -15 |
| -90 | | 15 | 45 | 90 | 0 1 0 | -60 | -60 |
| -90 | | 15 | 45 | 90 | 0 1 1 | 30 | 30 |
| -90 | | 15 | 45 | 90 | 1 0 0 | -75 | -75 |
| -90 | | 15 | 45 | 90 | 1 0 1 | 15 | 15 |
| -90 | | 15 | 45 | 90 | 1 1 0 | -30 | -30 |
| -90 | | 15 | 45 | 90 | 1 1 1 | 60 | 60 |
| -90 | 7,5 | 15 | 45 | 90 | 0 0 0 0 | *-112,5* | 67,5 |
| -90 | 7,5 | 15 | 45 | 90 | 0 0 0 1 | -22,5 | -22,5 |
| -90 | 7,5 | 15 | 45 | 90 | 0 0 1 0 | -67,5 | -67,5 |
| -90 | 7,5 | 15 | 45 | 90 | 0 0 1 1 | 22,5 | 22,5 |
| -90 | 7,5 | 15 | 45 | 90 | 0 1 0 0 | -82,5 | -82,5 |
| -90 | 7,5 | 15 | 45 | 90 | 0 1 0 1 | 7,5 | 7,5 |
| -90 | 7,5 | 15 | 45 | 90 | 0 1 1 0 | -37,5 | -37,5 |
| -90 | 7,5 | 15 | 45 | 90 | 0 1 1 1 | 52,5 | 52,5 |
| -90 | 7,5 | 15 | 45 | 90 | 1 0 0 0 | *-97,5* | 82,5 |
| -90 | 7,5 | 15 | 45 | 90 | 1 0 0 1 | -7,5 | -7,5 |
| -90 | 7,5 | 15 | 45 | 90 | 1 0 1 0 | -52,5 | -52,5 |
| -90 | 7,5 | 15 | 45 | 90 | 1 0 1 1 | 37,5 | 37,5 |
| -90 | 7,5 | 15 | 45 | 90 | 1 1 0 0 | -67,5 | -67,5 |
| -90 | 7,5 | 15 | 45 | 90 | 1 1 0 1 | 22,5 | 22,5 |
| -90 | 7,5 | 15 | 45 | 90 | 1 1 1 0 | -22,5 | -22,5 |
| -90 | 7,5 | 15 | 45 | 90 | 1 1 1 1 | 67,5 | 67,5 |

SIGNALLING OF SPATIAL AUDIO PARAMETERS

CROSS REFERENCE TO RELATED APPLICATION

This patent application is a U.S. National Stage application of International Patent Application Number PCT/FI2019/050412 filed May 29, 2019, which is hereby incorporated by reference in its entirety, and claims priority to GB 1808930.0 filed May 31, 2018.

FIELD

The present application relates to apparatus and methods for signalling of spatial audio parameters, but not exclusively for signalling of spatial coherence with orientation and spherical sector parameters.

BACKGROUND

Parametric spatial audio processing is a field of audio signal processing where the spatial aspect of the sound is described using a set of parameters. For example, in parametric spatial audio capture from microphone arrays, it is a typical and an effective choice to estimate from the microphone array signals a set of parameters such as directions of the sound in frequency bands, and the ratios between the directional and non-directional parts of the captured sound in frequency bands. These parameters are known to well describe the perceptual spatial properties of the captured sound at the position of the microphone array. These parameters can be utilized in synthesis of the spatial sound accordingly, for headphones binaurally, for loudspeakers, or to other formats, such as Ambisonics.

The directions and direct-to-total energy ratios in frequency bands are thus a parameterization that is particularly effective for spatial audio capture.

A parameter set consisting of a direction parameter in frequency bands and an energy ratio parameter in frequency bands (indicating the directionality of the sound) can be also utilized as the spatial metadata for an audio codec. For example, these parameters can be estimated from microphone-array captured audio signals as well as other input formats, and for example a stereo signal can be generated from the microphone array signals to be conveyed with the spatial metadata. The stereo signal could be encoded, for example, with an EVS (in dual-mono configuration) or AAC encoder. A corresponding decoder can decode the audio signals into PCM signals, and process the sound in frequency bands (using the spatial metadata) to obtain the spatial output, for example a binaural output.

The aforementioned solution is particularly suitable for encoding captured spatial sound from microphone arrays (e.g., in mobile phones, VR cameras, stand-alone microphone arrays). It may be desirable for such an encoder to be able to encode the metadata parameters to more accurately convey the relevant aspects of the input audio signals.

SUMMARY

There is provided according to a first aspect an apparatus comprising means for: determining, for two or more speaker channel audio signals, at least one spatial audio parameter for providing spatial audio reproduction; determining between the two or more speaker channel audio signals at least one audio signal relationship parameter, the at least one audio signal relationship parameter being associated with at least one coherence parameter, in such a way that the at least one coherence parameter provides at least one inter-channel coherence information between the two or more speaker channel audio signals for at least two frequency bands, so as to reproduce the two or more speaker channel audio signals based on the at least one spatial audio parameter and the at least one audio signal relationship parameter; and transmitting the at least one spatial audio parameter and at least one information associated with the at least one inter-channel coherence using at least one determined value.

The means for transmitting is further for transmitting the at least one audio signal relationship parameter and the means for transmitting the at least one information associated with the at least one inter-channel coherence using the at least one determined value may be for transmitting at least one of: at least one orientation of the at least one coherence parameter; at least one width of the at least one coherence parameter; and at least one extent of the at least one coherence parameter.

The at least one determined value may comprise at least one of: at least one orientation code; at least one width code; and at least one extent code.

The means for determining, for two or more speaker channel audio signals, at least one spatial audio parameter for providing spatial audio reproduction may be for determining, for the two or more speaker channel audio signals, at least one direction parameter and/or at least one energy ratio.

The means for may be further for determining a transport audio signal from the two or more speaker channel audio signals, wherein the two or more speaker channel audio signals can be reproduced based on the at least one spatial audio parameter, the at least one coherence parameter and/or the transport audio signal.

The means for determining between the two or more speaker channel audio signals at least one coherence parameter may be for determining a spread coherence parameter, wherein the spread coherence parameter may be determined based on an inter-channel coherence information between two or more speaker channel audio signals spatially adjacent to an identified speaker channel audio signal, the identified speaker channel audio signal being identified based on the at least one spatial audio parameter.

The means for determining a spread coherence parameter may be further for: determining a stereoness parameter associated with indicating that the two or more speaker channel audio signals are reproduced coherently using two speaker channel audio signals spatially adjacent to the identified speaker channel audio signal, the identified speaker channel audio signal being the speaker channel audio signal spatially closest to the at least one direction parameter; determining a coherent panning parameter associated with indicating that the two or more speaker channel audio signals are reproduced coherently using at least two or more speaker channel audio signals spatially adjacent to the identified speaker channel audio signal; and generating the spread coherence parameter based on the stereoness parameter and the coherent panning parameter.

The means for generating the spread coherence parameter based on the stereoness parameter and the coherent panning parameter may be further for: determining a main direction analysis to identify a speaker nearest to the at least one direction parameter; searching from a direction from the identified speaker and each search with an area comprising an angle from 0 to 180 degrees in a series of angle steps; estimating average coherence values between a defined main speaker channel and any speaker channels within the search area; determining a substantially constant coherence area based on the average coherence values; setting a spread extent at two times the largest coherence area; and defining the coherence panning parameter based on the spread extent.

The means for defining the coherence panning parameter based on the largest coherence area may be for: determining a speaker closest to the at least one direction parameter; determining a normalized coherence $c_{a,\ i}$ between the speaker and all speakers inside the largest coherence area; omitting speakers with energy below a threshold energy; selecting a minimum coherence from the remaining speakers; determining an energy distribution parameter based on the energy distribution among the remaining speakers; multiplying the energy distribution parameter with the largest coherence area to determine the coherence panning parameter.

The means for determining the stereoness parameter may further be for: determining a main direction analysis to identify a speaker nearest to the at least one direction parameter; searching from a direction from the identified speaker and each search with a ring defined by an angle from 0 to 180 degrees in a series of angle steps; estimating average coherence values and average energy values for all speaker located near to the search ring; determining a largest coherence ring angle based on the average coherence values and average energy values; setting a spread extent at two times the largest coherence ring angle; and defining the stereoness parameter based on the spread extent.

The means for defining the stereoness parameter based on the spread extent may be for: identifying a speaker on the largest coherence ring that has the most energy; determining normalized coherences between the identified speaker and other speakers on the largest coherence ring; determining a mean of the normalised coherences weighted by respective energies; determining a ratio of energies on the largest coherence ring and inside the largest coherence ring; and multiplying the ratio of energies and mean of normalised coherences to form the stereoness parameter.

According to a second aspect there is provided a method for spatial audio signal processing, comprising: determining, for two or more speaker channel audio signals, at least one spatial audio parameter for providing spatial audio reproduction; determining between the two or more speaker channel audio signals at least one audio signal relationship parameter, the at least one audio signal relationship parameter being associated with at least one coherence parameter, in such a way that the at least one coherence parameter provides at least one inter-channel coherence information between the two or more speaker channel audio signals for at least two frequency bands, so as to reproduce the two or more speaker channel audio signals based on the at least one spatial audio parameter and the at least one audio signal relationship parameter; and transmitting the at least one spatial audio parameter and at least one information associated with the at least one inter-channel coherence using at least one determined value.

Transmitting at least one information associated with the at least one inter-channel coherence using at least one determined value may comprise transmitting at least one of: at least one orientation of the at least one coherence parameter; at least one width of the at least one coherence parameter; and at least one extent of the at least one coherence parameter.

The at least one determined value may comprise at least one of: at least one orientation code; at least one width code; and at least one extent code.

Determining, for two or more speaker channel audio signals, at least one spatial audio parameter for providing spatial audio reproduction may comprise determining, for the two or more speaker channel audio signals, at least one direction parameter and/or at least one energy ratio.

The method may comprise determining a transport audio signal from the two or more speaker channel audio signals, wherein the two or more speaker channel audio signals can be reproduced based on the at least one spatial audio parameter, the at least one coherence parameter and/or the transport audio signal.

Determining between the two or more speaker channel audio signals at least one coherence parameter may comprise determining a spread coherence parameter, wherein the spread coherence parameter may be determined based on an inter-channel coherence information between two or more speaker channel audio signals spatially adjacent to an identified speaker channel audio signal, the identified speaker channel audio signal being identified based on the at least one spatial audio parameter.

Determining a spread coherence parameter may comprise: determining a stereoness parameter associated with indicating that the two or more speaker channel audio signals are reproduced coherently using two speaker channel audio signals spatially adjacent to the identified speaker channel audio signal, the identified speaker channel audio signal being the speaker channel audio signal spatially closest to the at least one direction parameter; determining a coherent panning parameter associated with indicating that the two or more speaker channel audio signals are reproduced coherently using at least two or more speaker channel audio signals spatially adjacent to the identified speaker channel audio signal; and generating the spread coherence parameter based on the stereoness parameter and the coherent panning parameter.

Generating the spread coherence parameter based on the stereoness parameter and the coherent panning parameter may comprise: determining a main direction analysis to identify a speaker nearest to the at least one direction parameter; searching from a direction from the identified speaker and each search with an area comprising an angle from 0 to 180 degrees in a series of angle steps; estimating average coherence values between a defined main speaker channel and any speaker channels within the search area; determining a substantially constant coherence area based on the average coherence values; setting a spread extent at two times the largest coherence area; and defining the coherence panning parameter based on the spread extent.

Defining the coherence panning parameter based on the largest coherence area may comprise: determining a speaker closest to the at least one direction parameter; determining a normalized coherence $c_{a,\ i}$ between the speaker and all speakers inside the largest coherence area; omitting speakers with energy below a threshold energy; selecting a minimum coherence from the remaining speakers; determining an energy distribution parameter based on the energy distribution among the remaining speakers; multiplying the energy distribution parameter with the largest coherence area to determine the coherence panning parameter.

Determining the stereoness parameter may comprise: determining a main direction analysis to identify a speaker nearest to the at least one direction parameter; searching from a direction from the identified speaker and each search with a ring defined by an angle from 0 to 180 degrees in a series of angle steps; estimating average coherence values and average energy values for all speaker located near to the search ring; determining a largest coherence ring angle based on the average coherence values and average energy values; setting a spread extent at two times the largest coherence ring angle; and defining the stereoness parameter based on the spread extent.

Defining the stereoness parameter based on the spread extent may comprise: identifying a speaker on the largest coherence ring that has the most energy; determining normalized coherences between the identified speaker and other speakers on the largest coherence ring; determining a mean of the normalised coherences weighted by respective energies; determining a ratio of energies on the largest coherence ring and inside the largest coherence ring; and multiplying the ratio of energies and mean of normalised coherences to form the stereoness parameter.

According to a third aspect there is provided an apparatus comprising at least one processor and at least one memory including a computer program code, the at least one memory and the computer program code configured to, with the at least one processor, cause the apparatus at least to: determine, for two or more speaker channel audio signals, at least one spatial audio parameter for providing spatial audio reproduction; determine between the two or more speaker channel audio signals at least one audio signal relationship parameter, the at least one audio signal relationship parameter being associated with at least one coherence parameter, in such a way that the at least one coherence parameter provides at least one inter-channel coherence information between the two or more speaker channel audio signals for at least two frequency bands, so as to reproduce the two or more speaker channel audio signals based on the at least one spatial audio parameter and the at least one audio signal relationship parameter; and transmit the at least one spatial audio parameter and at least one information associated with the at least one inter-channel coherence using at least one determined value.

The apparatus caused to transmit at least one information associated with the at least one inter-channel coherence using at least one determined value may cause the apparatus to transmit at least one of: at least one orientation of the at least one coherence parameter; at least one width of the at least one coherence parameter; and at least one extent of the at least one coherence parameter.

The at least one determined value may comprise at least one of: at least one orientation code; at least one width code; and at least one extent code.

The apparatus caused to determine, for two or more speaker channel audio signals, at least one spatial audio parameter for providing spatial audio reproduction may be caused to determine, for the two or more speaker channel audio signals, at least one direction parameter and/or at least one energy ratio.

The apparatus may be caused to determine a transport audio signal from the two or more speaker channel audio signals, wherein the two or more speaker channel audio signals can be reproduced based on the at least one spatial audio parameter, the at least one coherence parameter and/or the transport audio signal.

The apparatus caused to determine between the two or more speaker channel audio signals at least one coherence parameter may be caused to determine a spread coherence parameter, wherein the spread coherence parameter may be determined based on an inter-channel coherence information between two or more speaker channel audio signals spatially adjacent to an identified speaker channel audio signal, the identified speaker channel audio signal being identified based on the at least one spatial audio parameter.

The apparatus caused to determine a spread coherence parameter may be caused to: determine a stereoness parameter associated with indicating that the two or more speaker channel audio signals are reproduced coherently using two speaker channel audio signals spatially adjacent to the identified speaker channel audio signal, the identified speaker channel audio signal being the speaker channel audio signal spatially closest to the at least one direction parameter; determine a coherent panning parameter associated with indicating that the two or more speaker channel audio signals are reproduced coherently using at least two or more speaker channel audio signals spatially adjacent to the identified speaker channel audio signal; and generate the spread coherence parameter based on the stereoness parameter and the coherent panning parameter.

The apparatus caused to generate the spread coherence parameter based on the stereoness parameter and the coherent panning parameter may be caused to: determine a main direction analysis to identify a speaker nearest to the at least one direction parameter; search from a direction from the identified speaker and each search with an area comprising an angle from 0 to 180 degrees in a series of angle steps; estimate average coherence values between a defined main speaker channel and any speaker channels within the search area; determine a substantially constant coherence area based on the average coherence values; set a spread extent at two times the largest coherence area; and define the coherence panning parameter based on the spread extent.

The apparatus caused to define the coherence panning parameter based on the largest coherence area may be caused to: determine a speaker closest to the at least one direction parameter; determine a normalized coherence $c_{a,i}$ between the speaker and all speakers inside the largest coherence area; omit speakers with energy below a threshold energy; select a minimum coherence from the remaining speakers; determine an energy distribution parameter based on the energy distribution among the remaining speakers; multiply the energy distribution parameter with the largest coherence area to determine the coherence panning parameter.

The apparatus caused to determine the stereoness parameter may be caused to: determine a main direction analysis to identify a speaker nearest to the at least one direction parameter; search from a direction from the identified speaker and each search with a ring defined by an angle from 0 to 180 degrees in a series of angle steps; estimate average coherence values and average energy values for all speaker located near to the search ring; determine a largest coherence ring angle based on the average coherence values and average energy values; set a spread extent at two times the largest coherence ring angle; and define the stereoness parameter based on the spread extent.

The apparatus caused to define the stereoness parameter based on the spread extent may be caused to: identify a speaker on the largest coherence ring that has the most energy; determine normalized coherences between the identified speaker and other speakers on the largest coherence ring; determine a mean of the normalised coherences weighted by respective energies; determine a ratio of energies on the largest coherence ring and inside the largest coherence ring; and multiply the ratio of energies and mean of normalised coherences to form the stereoness parameter.

According to a fourth aspect there is provided a computer program comprising instructions [or a computer readable medium comprising program instructions] for causing an apparatus to perform at least the following: determining, for two or more speaker channel audio signals, at least one spatial audio parameter for providing spatial audio reproduction; determining between the two or more speaker channel audio signals at least one audio signal relationship parameter, the at least one audio signal relationship parameter being associated with at least one coherence parameter, in such a way that the at least one coherence parameter provides at least one inter-channel coherence information between the two or more speaker channel audio signals for at least two frequency bands, so as to reproduce the two or more speaker channel audio signals based on the at least one spatial audio parameter and the at least one audio signal relationship parameter; and transmitting the at least one spatial audio parameter and at least one information associated with the at least one inter-channel coherence using at least one determined value.

According to a fifth aspect there is provided a non-transitory computer readable medium comprising program instructions for causing an apparatus to perform at least the following: determining, for two or more speaker channel audio signals, at least one spatial audio parameter for providing spatial audio reproduction; determining between the two or more speaker channel audio signals at least one audio signal relationship parameter, the at least one audio signal relationship parameter being associated with at least one coherence parameter, in such a way that the at least one coherence parameter provides at least one inter-channel coherence information between the two or more speaker channel audio signals for at least two frequency bands, so as to reproduce the two or more speaker channel audio signals based on the at least one spatial audio parameter and the at least one audio signal relationship parameter; and transmitting the at least one spatial audio parameter and at least one information associated with the at least one inter-channel coherence using at least one determined value.

According to an sixth aspect there is provided an apparatus comprising: spatial audio parameter determining circuitry configured to determine, for two or more speaker channel audio signals, at least one spatial audio parameter for providing spatial audio reproduction; audio signal relationship determining circuitry configured to determine between the two or more speaker channel audio signals at least one audio signal relationship parameter, the at least one audio signal relationship parameter being associated with at least one coherence parameter, in such a way that the at least one coherence parameter provides at least one inter-channel coherence information between the two or more speaker channel audio signals for at least two frequency bands, so as to reproduce the two or more speaker channel audio signals based on the at least one spatial audio parameter and the at least one audio signal relationship parameter; and transmitting controlling circuitry for controlling transmitting the at least one spatial audio parameter and at least one information associated with the at least one inter-channel coherence using at least one determined value.

According to a seventh aspect there is provided a computer readable medium comprising program instructions for causing an apparatus to perform at least the following: determining, for two or more speaker channel audio signals, at least one spatial audio parameter for providing spatial audio reproduction; determining between the two or more speaker channel audio signals at least one audio signal relationship parameter, the at least one audio signal relationship parameter being associated with at least one coherence parameter, in such a way that the at least one coherence parameter provides at least one inter-channel coherence information between the two or more speaker channel audio signals for at least two frequency bands, so as to reproduce the two or more speaker channel audio signals based on the at least one spatial audio parameter and the at least one audio signal relationship parameter; and transmitting the at least one spatial audio parameter and at least one information associated with the at least one inter-channel coherence using at least one determined value.

An apparatus comprising means for performing the actions of the method as described above.

An apparatus configured to perform the actions of the method as described above.

A computer program comprising program instructions for causing a computer to perform the method as described above.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For a better understanding of the present application, reference will now be made by way of example to the accompanying drawings in which:

FIGS. 4*a* to 4*f* shows flow diagrams of the operation of the analysis processor as shown in FIG. 2 according to some embodiments;

FIGS. 9*a* and 9*b* show example quantization tables showing the encoding of the spread coherence orientation according to some embodiments

EMBODIMENTS OF THE APPLICATION

Figure 1:
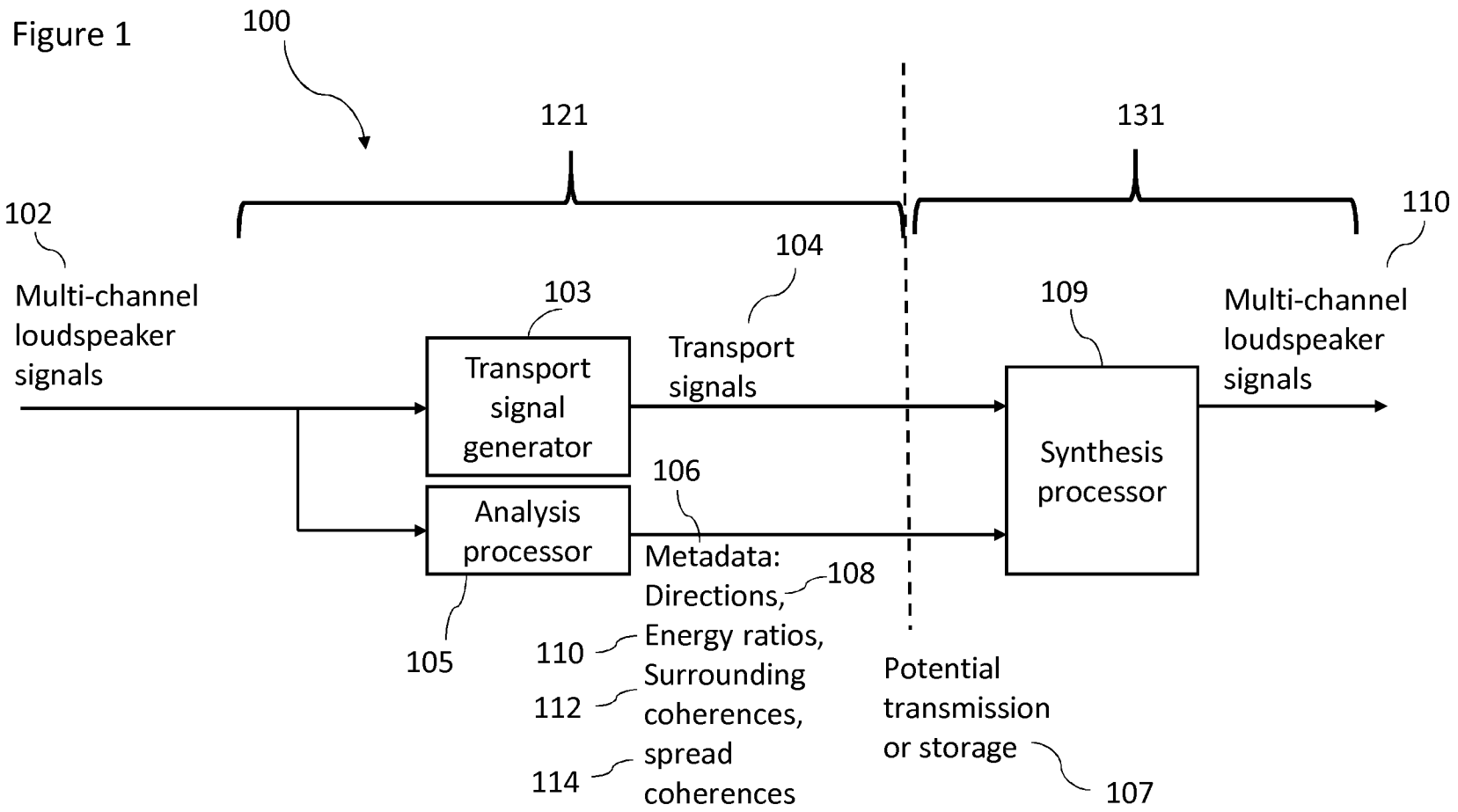
FIG. 1 shows schematically a system of apparatus suitable for implementing some embodiments.

The following describes in further detail suitable apparatus and possible mechanisms for the provision of effective encoding for spatial analysis derived metadata parameters.

As discussed previously spatial metadata parameters such as direction and direct-to-total energy ratio (or diffusenessratio, absolute energies, or any suitable expression indicating the directionality/non-directionality of the sound at the given time-frequency interval) parameters in frequency bands are particularly suitable for expressing the perceptual properties of sound fields both natural (in other words captured sound fields) and synthetic (in other words generated sound fields such as multichannel loudspeaker mixes).

An example of suitable spatial parameters are the coherence parameters. The concept as discussed in further detail hereafter is the provision of efficient transmission of parameters over a large range of bit rates.

The concepts as detailed hereafter in the examples relate to audio encoding and decoding using a sound-field related parameterization (direction(s) and ratio(s) in frequency bands), where a solution is provided to improve the reproduction quality of (both produced and recorded) loudspeaker surround mixes encoded with the aforementioned parameterization.

Furthermore the embodiments discuss improved perceived quality of the loudspeaker surround mixes by analysis of inter-channel coherence information of the loudspeaker signals in frequency bands including the orientation and the width (extent) information of the inter-channel coherence area or group of channels/loudspeakers.

Additionally the examples hereafter show a spatial coherence parameter(s) being conveyed along with the spatial parameter(s) (i.e., direction and energy ratio), where the orientation and width/extent is provided to the encoding efficiently using a 'orientation code' and in some embodiments an 'orientation code' and 'circular sector code'. These codes may in some embodiments both consume 4 bits per each directional parameter.

The examples as discussed hereafter furthermore describe the reproduction of sound based on the directional parameter(s) and the spatial coherence parameter(s) including the orientation code and the circular sector code, such that the spatial coherence parameter affects the cross correlation of the reproduced audio signals according to the orientation code and circular sector code.

The cross correlation of the output signals may refer to the cross correlation of the reproduced loudspeaker signals, or of the reproduced binaural signals, or of the reproduced Ambisonic signals.

In some of the following examples the signalling of the 'Spread coherence' parameter is in the format of area orientation and extent. The spread orientation code in this example format has a 0-180 degree rotation, and the circular sector code in this example format has a 0-360 degree central angle for the spread extent. In some embodiments, a spherical sector code may be alternatively used.

As such the concepts as discussed in further detail with example implementations relate to audio encoding and decoding using a spatial audio or sound-field related parameterization (for example other spatial metadata parameters may include direction(s), energy ratio(s), direct-to-total ratio(s), directional stability or other suitable parameter). The concept furthermore discloses embodiments comprising methods and apparatus which aim to improve the reproduction quality of loudspeaker surround mixes encoded with the aforementioned parameterization.

The concept embodiments improve the quality of the loudspeaker surround mixes by analysing the inter-channel coherence of the loudspeaker signals in frequency bands, conveying a spatial coherence parameter(s) along with the directional parameter(s), and reproducing the sound based on the directional parameter(s) and the spatial coherence parameter(s), such that the spatial coherence affects the cross correlation of the reproduced audio signals.

The term coherence or cross-correlation here is not interpreted strictly as one specific similarity value between signals, such as the normalised, square-value but reflects similarity values between playback audio signals in general and may be complex (with phase), absolute, normalised, or square values. The coherence parameter may be expressed more generally as an audio signal relationship parameter indicating a similarity of audio signals in any way.

The coherence of the output signals may refer to the coherence of the reproduced loudspeaker signals, or of the reproduced binaural signals, or of the reproduced Ambisonic signals.

The discussed concept implementations therefore may provide two related parameters such as spatial coherence spanning an area in certain direction, which relates to the directional part of the sound energy;

surrounding spatial coherence, which relates to the ambient/non-directional part of the sound energy.

Moreover, the ratio parameter may as discussed in further detail hereafter be modified based on the determined spatial coherence or audio signal relationship parameter(s) for further audio quality improvement.

In the example embodiments detailed below a typical scenario is described where the loudspeaker surround mix is a horizontal surround setup. In other embodiments spatial coherence or audio signal relationship parameters could be estimated also from "3D" loudspeaker configurations. In other words in some embodiments the spatial coherence or audio signal relationship parameters may be associated with directions located 'above' or 'below' a defined plane (e.g. elevated or depressed loudspeakers relative to a defined 'horizontal' plane).

There may be any degree of coherence between any of the channels in a loudspeaker mix. In theory, in order to accurately describe this perceptually, all information conveyed by the covariance matrix of the loudspeaker signals in frequency bands should be transmitted in the spatial metadata. The size of such a covariance matrix is N×N, where N is the number of loudspeaker channels. For a 5-channel system this would mean transmitting for each time-frequency analysis interval 10 complex cross-correlation values, for a 7-channel system 21 complex cross-correlation values and so on. Clearly, this would produce too much metadata for a suitable low-bit-rate codec. Hence in the following embodiments examples are described where only the perceptually essential aspects are described by the spatial metadata in order to keep the bit rate low.

For completeness, in a scope other than that of the present embodiments, a practical spatial audio encoder that would optimize transmission of the inter-channel relations of a loudspeaker mix would not transmit the whole covariance matrix of a loudspeaker mix, but provide a set of upmixing parameters to recover a surround sound signal at the decoder side that has a substantially similar covariance matrix than the original surround signal had. Solutions such as these have been employed. However, such methods are specific of encoding and decoding only existing loudspeaker mixes. The present context is spatial audio encoding using the direction and ratio metadata that is a loudspeaker-setup independent parameterization in particular suited for captured spatial audio (and hence requires the present methods to improve the quality in case of loudspeaker surround inputs).

Thus, the examples are focused on solving the reproduction quality of 5.1 and 7.1 (and other format) channel loudspeaker mixes using the perceptually determined loudspeaker-setup independent parameterization methods as discussed hereafter.

Within actual 5.1 and 7.1 channel loudspeaker mixes, three typical cases of spatial coherence that are an issue related to the direction-ratio parameterization exist:

1) The sound is reproduced coherently using two loudspeakers for creating an "airy" perception (e.g., use front left and right instead of centre);

2) The sound is reproduced coherently using three (or more) loudspeakers for creating a "close" perception (e.g., use front left, right and centre instead of only centre); and 3) The sound is reproduced coherently from all (or nearly all) loudspeakers for creating an "inside-the-head" or "above" perception.

It is shown how to estimate and describe these three cases using only 2 parameters for each time-frequency interval (additionally to the already existing direction and direct-to-total ratio parameters). It is proposed that using this parameter set a similar spatial quality for the reproduced output can be obtained as by reproducing the spatial sound with the information contained by the whole covariance matrix.

It is also shown how to synthesize the spatial sound based on the proposed parameters, by adopting existing synthesis techniques known in the literature.

With respect to FIG. 1 an example apparatus and system for implementing embodiments of the application are shown. The system 100 is shown with an 'analysis' part 121 and a 'synthesis' part 131. The 'analysis' part 121 is the part from receiving the multi-channel loudspeaker signals up to an encoding of the metadata and transport audio signal and the 'synthesis' part 131 is the part from a decoding of the encoded metadata and transport audio signal to the presentation of the synthesized signal (for example in multi-channel loudspeaker form).

The input to the system 100 and the 'analysis' part 121 is the multi-channel loudspeaker signals 102. In the following examples a 5.1 channel loudspeaker signal input is described, however any suitable input loudspeaker (or synthetic multi-channel) format may be implemented in other embodiments.

The multi-channel loudspeaker signals are passed to a transport signal generator 103 and to an analysis processor 105.

The transport signal generator 103 is configured to receive the input signals 102 and generate suitable transport audio signals 104. The transport audio signals may also be known as associated audio signals and be based on the spatial audio signals (which implicitly or explicitly contain directional information of a sound field and which is input to the system). For example, in some embodiments the transport signal generator 103 is configured to downmix or otherwise select or combine the input audio signals to a determined number of channels and output these as transport signals 104. The transport signal generator 103 may be configured to generate any suitable number of transport audio signals (or channels), for example in some embodiments the transport signal generator is configured to generate two transport audio signals. In some embodiments the transport signal generator 103 is further configured to encode the audio signals. For example, in some embodiments the audio signals may be encoded using an advanced audio coding (AAC) or enhanced voice services (EVS) compression coding. In some embodiments the transport signal generator 103 may be configured to equalize the audio signals, apply automatic noise control, dynamic processing, or any other suitable processing. In some embodiments the transport signal generator 103 can further take the output of the analysis processor 105 as an input to facilitate the generation of the transport signal 104.

In some embodiments the transport signal generator 103 is optional and the multi-channel loudspeaker signals are passed unprocessed.

In some embodiments the analysis processor 105 is also configured to receive the multi-channel loudspeaker signals and analyse the signals to produce metadata 106 associated with the multi-channel loudspeaker signals and thus associated with the transport signal 104. The analysis processor 105 can, for example, be a computer (running suitable software stored on memory and on at least one processor), or alternatively a specific device utilizing, for example, FPGAs or ASICs. As shown herein in further detail the metadata may comprise, for each time-frequency analysis interval, a direction parameter 108, an energy ratio parameter 110, a surrounding coherence parameter 112, and a spread coherence parameter 114. The direction parameter and the energy ratio parameters may in some embodiments be considered to be spatial audio parameters. In other words the spatial audio parameters comprise parameters which aim to characterize the sound-field created by the multi-channel loudspeaker signals (or two or more playback audio signals in general).

In some embodiments the parameters generated may differ from frequency band to frequency band. Thus, for example in band X all of the parameters are generated and transmitted, whereas in band Y a different number of the parameters is generated and transmitted, and furthermore in band Z no parameters are generated or transmitted. A practical example of this may be that for some frequency bands such as the highest band some of the parameters are not required for perceptual reasons.

Additionally, the analysis processor 105 or a suitable encoder may be configured to encode the metadata. For example, as described in further detail hereafter.

The transport signals 104 and the metadata 106 may be transmitted or stored, this is shown in FIG. 1 by the dashed line 107. Before the transport signals 104 and the metadata 106 are transmitted or stored they may be coded in order to reduce bit rate, and multiplexed to one stream. The encoding and the multiplexing may be implemented using any suitable scheme and the encoding of the metadata is described in embodiments.

In the decoder side, the received or retrieved data (stream) may be demultiplexed, and the coded streams decoded in order to obtain the transport signals and the metadata. This receiving or retrieving of the transport signals and the metadata is also shown in FIG. 1 with respect to the right-hand side of the dashed line 107.

The system 100 'synthesis' part 131 shows a synthesis processor 109 configured to receive the transport signals 104 and the metadata 106 and re-creates the multi-channel loudspeaker signals 110 (or in some embodiments any suitable output format such as binaural or Ambisonics signals, depending on the use case) and based on the transport signals 104 and the metadata 106. The synthesis processor 109 can in some embodiments be a computer (running suitable software stored on memory and on at least one processor), or alternatively a specific device utilizing, for example, FPGAs or ASICs.

Figure 2:
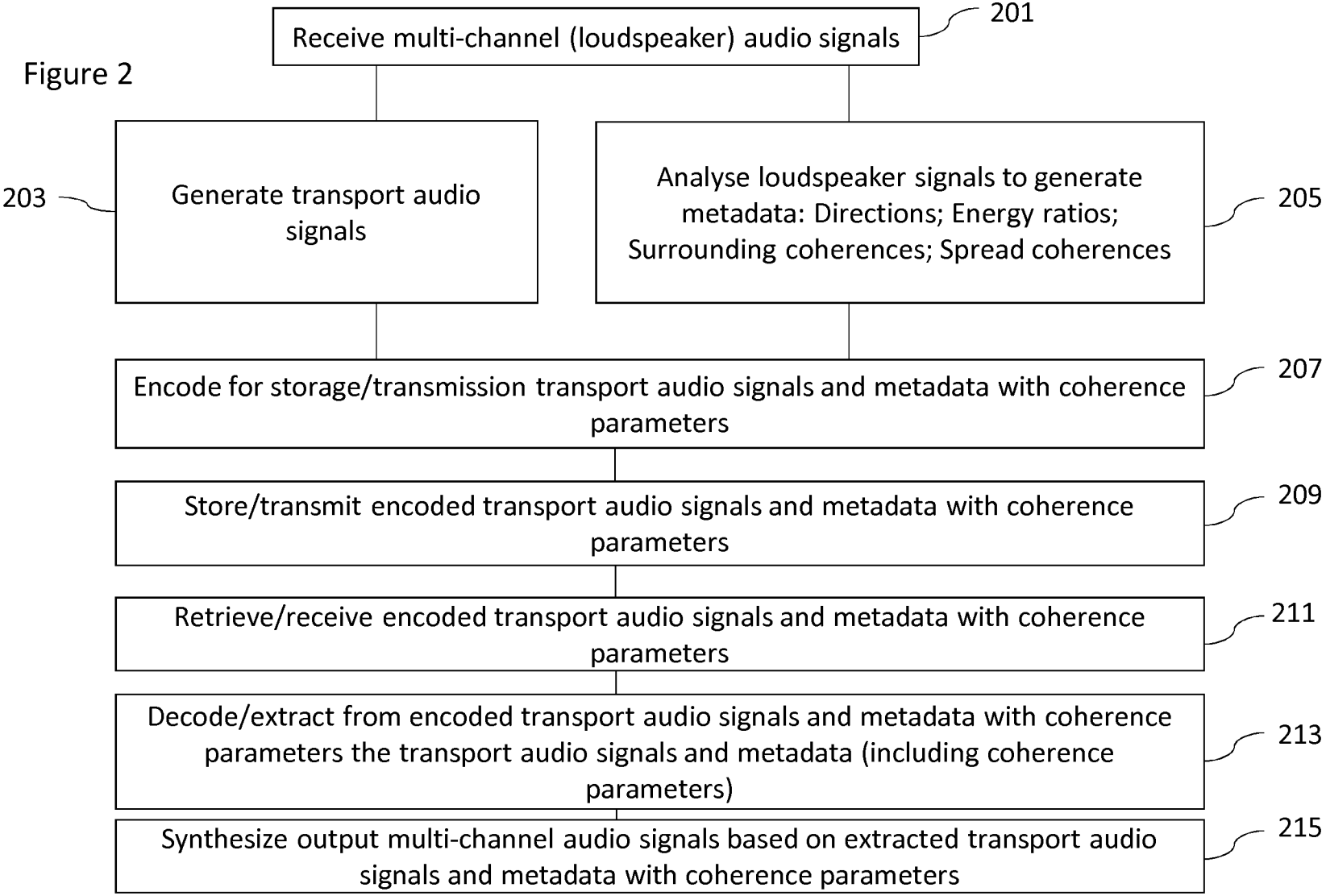
FIG. 2 shows a flow diagram of the operation of the system as shown in FIG. 1 according to some embodiments.

With respect to FIG. 2 an example flow diagram of the overview shown in FIG. 1 is shown.

First the system (analysis part) is configured to receive multi-channel (loudspeaker) audio signals as shown in FIG. 2 by step 201.

Then the system (analysis part) is configured to generate a transport audio signals as shown in FIG. 2 by step 203.

Also the system (analysis part) is configured to analyse loudspeaker signals to generate metadata: Directions; Energy ratios; Surrounding coherences; Spread coherences as shown in FIG. 2 by step 205.

The system is then configured to encode for storage/transmission the transport signal and metadata with coherence parameters as shown in FIG. 2 by step 207.

After this the system may store/transmit the encoded transport signal and metadata with coherence parameters as shown in FIG. 2 by step 209.

The system may retrieve/receive the encoded transport signal and metadata with coherence parameters as shown in FIG. 2 by step 211.

Then the system is configured to extract from the encoded transport signal and metadata with coherence parameters a transport signal and metadata with coherence parameters as shown in FIG. 2 by step 213.

The system (synthesis part) is configured to synthesize an output multi-channel audio signal (which as discussed earlier may be any suitable output format such as binaural, multi-channel loudspeaker or Ambisonics signals, depending on the use case) based on extracted transport signal and metadata with coherence parameters as shown in FIG. 2 by step 215.

Figure 3:
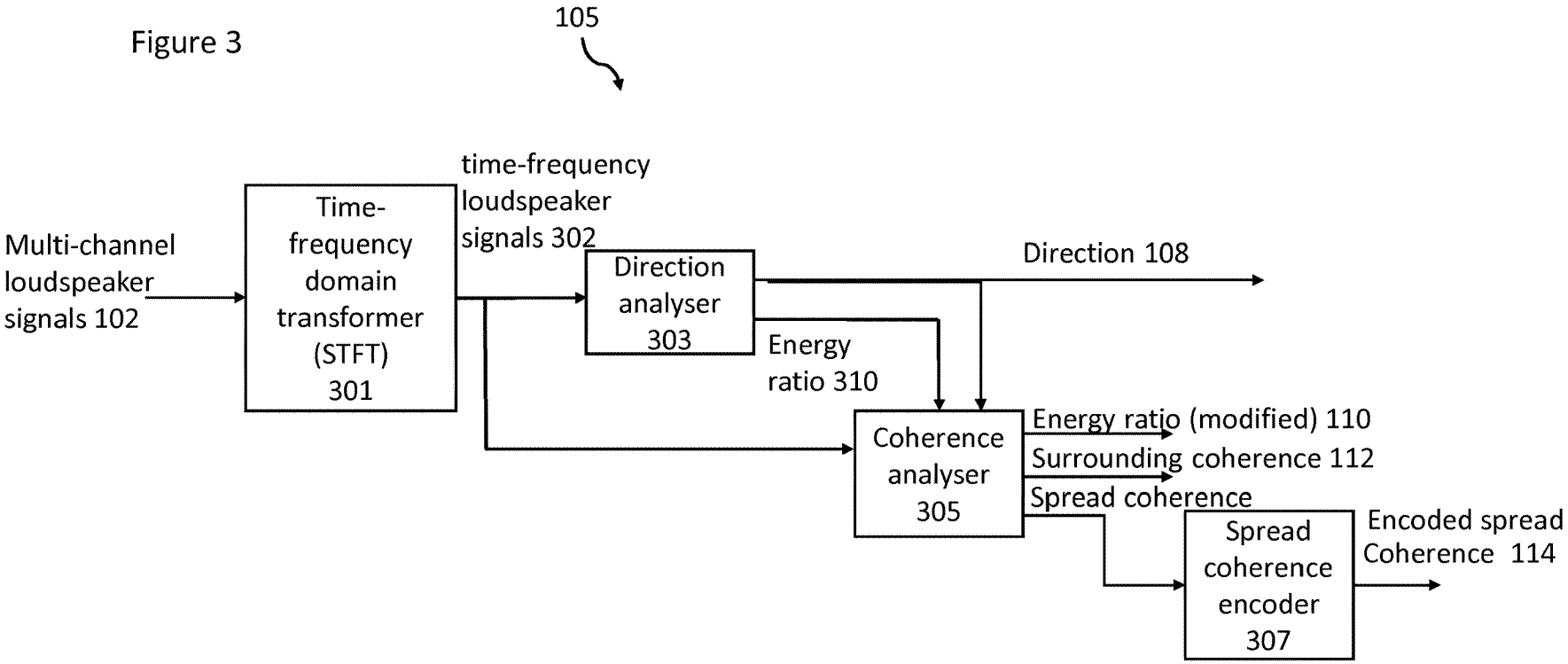
FIG. 3 shows schematically the analysis processor as shown in FIG. 1 according to some embodiments.

With respect to FIG. 3 an example analysis processor 105 (as shown in FIG. 1) according to some embodiments is described in further detail. The analysis processor 105 in some embodiments comprises a time-frequency domain transformer 301.

In some embodiments the time-frequency domain transformer 301 is configured to receive the multi-channel loudspeaker signals 102 and apply a suitable time to frequency domain transform such as a Short Time Fourier Transform (STFT) in order to convert the input time domain signals into a suitable time-frequency signals 302. These time-frequency signals may be passed to a direction analyser 303 and to a coherence analyser 305.

Thus for example the time-frequency signals 302 may be represented in the time-frequency domain representation by $$s_i(b,n),$$

where b is the frequency bin index and n is the frame index and i is the loudspeaker channel index. In another expression, n can be considered as a time index with a lower sampling rate than that of the original time-domain signals. These frequency bins can be grouped into subbands that group one or more of the bins into a band index k=0, . . . , K−1. Each subband k has a lowest bin $b_{k,\ low}$ and a highest bin $b_{k,\ high}$, and the subband contains all bins from $b_{k,\ low}$ to $b_{k,\ high}$. The widths of the subbands can approximate any suitable distribution. For example the Equivalent rectangular bandwidth (ERB) scale or the Bark scale.

In some embodiments the analysis processor 105 comprises a direction analyser 303. The direction analyser 303 may be configured to receive the time-frequency signals 302 and based on these signals estimate direction parameters 108. The direction parameters may be determined based on any audio based 'direction' determination.

For example in some embodiments the direction analyser 303 is configured to estimate the direction with two or more loudspeaker signal inputs.

The direction analyser 303 may thus be configured to provide an azimuth for each frequency band and temporal frame, denoted as θ(k, n). Where the direction parameter is a 3D parameter, an example direction parameter may be azimuth θ(k, n), elevation φ(k, n). The direction parameter 108 may be also be passed to a coherence analyser 305.

With reference to FIG. 2, the direction parameter obtained by analysing loudspeaker signals to generate metadata in step 205 (and encoded for storage or transmission in step 207) may be expressed, e.g., in terms of azimuth and elevation or a spherical grid index.

In some embodiments further to the direction parameter the direction analyser 303 is configured to determine other suitable parameters which are associated with the determined direction parameter. For example in some embodiments the direction analyser is caused to determine an energy ratio parameter 110. The energy ratio may be considered to be a determination of the energy of the audio signal which can be considered to arrive from a direction. The direct-to-total energy ratio r(k, n) can for example be estimated using a stability measure of the directional estimate, or using any correlation measure, or any other suitable method to obtain an energy ratio parameter. In other embodiments the direction analyser is caused to determine and output the stability measure of the directional estimate, a correlation measure or other direction associated parameter.

The estimated direction 108 parameters may be output (and to be used in the synthesis processor). The estimated energy ratio parameters 110 may be passed to a coherence analyser 305. The parameters may, in some embodiments, be received in a parameter combiner (not shown) where the estimated direction and energy ratio parameters are combined with the coherence parameters as generated by the coherence analyser 305 described hereafter.

In some embodiments the analysis processor 105 comprises a coherence analyser 305. The coherence analyser 305 is configured to receive parameters (such as the azimuths (θ(k, n)) 108, and the direct-to-total energy ratios (r(k, n)) 110) from the direction analyser 303. The coherence analyser 305 may be further configured to receive the time-frequency signals ($s_i$(b, n)) 302 from the time-frequency domain transformer 301. All of these are in the time-frequency domain; b is the frequency bin index, k is the frequency band index (each band potentially consists of several bins b), n is the time index, and i is the loudspeaker channel.

Although directions and ratios are here expressed for each time index n, in some embodiments the parameters may be combined over several time indices. Same applies for the frequency axis, as has been expressed, the direction of several frequency bins b could be expressed by one direction parameter in band k consisting of several frequency bins b. The same applies for all of the discussed spatial parameters herein.

The coherence analyser 305 is configured to produce a number of coherence parameters. In the following disclosure there are the two parameters: surrounding coherence (γ(k, n)) and spread coherence (ζ(k, n)), both analysed in time-frequency domain. In addition, in some embodiments the coherence analyser 205 is configured to modify the associated parameters (for example the estimated energy ratios (r(k, n))).

In some embodiments a spread coherence encoder 307 is configured to receive the spread coherence parameter and encode it. In some embodiments the functionality of the spread coherence encoder 307 is incorporated within the coherence analyser 305 and the encoded spread coherence parameter 114 is output directly from the coherence analyser. In some embodiments the encoding and signalling of the spread coherence parameter is implemented by the signalling of a 'spread coherence' area orientation and extent parameter pair. Furthermore in some embodiments the 'spread coherence' area orientation and extent parameter pair is signalled by:

a spread orientation code with a 0-180 degree rotation, and a circular sector code with a 0-360 degree central angle for the spread extent.

In some embodiments only a circular sector code with a 0-360 degree central angle for the spread extent is used.

In some embodiments, a spherical sector code may be alternatively used. The example coding of the coherence aims to produce no or minimal loss at the codec input and allow for efficient transmission given the current bit rate constraint at the audio encoder. For example, in a communications-capable scenario, network congestion may significantly affect the audio coding bit rate through a single transmission resulting in frame-to-frame fluctuations.

The output of the coherence analyser 305 (and the spread coherence encoder 307), and specifically the spread coherence output may be passed to a spread coherence encoder configured to encode the output spread coherence and generate a suitable encoded spread coherence parameter 114.

In some embodiments therefore the coherence analyser 305 may be configured to calculate, the covariance matrix C for the given analysis interval consisting of one or more time indices n and frequency bins b. The size of the matrix is N×N, and the entries are denoted as $c_{ij}$, where i and j are loudspeaker channel indices.

Next, the coherence analyser 305 may be configured to determine the loudspeaker channel $i_c$ closest to the estimated direction (which in this example is azimuth θ).

$$i_c=\arg(\min(|\theta-\alpha_i|))$$

where $\alpha_i$ is the angle of the loudspeaker i.

In some embodiments, for example in the case of 3D loudspeaker setup, the elevation angle is also taken into account when determining the closest loudspeaker $i_c$. This may be implemented in any suitable manner, for example considering each orientation separately or computing all combinations in one go (and extracting the orientation from said information).

Furthermore in such embodiments the coherence analyser 305 is configured to determine the loudspeakers closest on the left $i_l$ and the right $i_r$ side of the loudspeaker $i_c$.

A normalized coherence between loudspeakers i and j is denoted as $$c'_{ij} = \frac{|c_{ij}|}{\sqrt{|c_{ii}c_{jj}|}},$$

using this equation, the coherence analyser 305 may be configured to calculate a normalized coherence $c'_{lr}$ between $i_l$ and $i_r$. In other words calculate $$c'_{lr} = \frac{|c_{lr}|}{\sqrt{|c_{ll}c_{rr}|}},$$

Furthermore the coherence analyser 305 may configured to determine the energy of the loudspeaker channels i using the diagonal entries of the covariance matrix $$E_i=c_{ii},$$

and determine a ratio between the energies of the $i_l$ and $i_r$ loudspeakers and $i_l$, $i_r$, and $i_c$ loudspeakers as $$\xi_{lr/lrc} = \frac{E_l + E_r}{E_l + E_r + E_c}.$$

The coherence analyser 305 may then use these determined variables to generate a 'stereoness' parameter $$\mu=c'_{lr}\xi_{lr/lrc}.$$

This 'stereoness' parameter has a value between 0 and 1. A value of 1 means that there is coherent sound in loudspeakers $i_l$ and $i_r$ and this sound dominates the energy of this sector. The reason for this could, for example, be the loudspeaker mix used amplitude panning techniques for creating an "airy" perception of the sound. A value of 0 means that no such techniques has been applied, and, for example, the sound may simply be positioned to the closest loudspeaker.

Furthermore the coherence analyser may be configured to detect, or at least identify, the situation where the sound is reproduced coherently using three (or more) loudspeakers for creating a "close" perception (e.g., use front left, right and centre instead of only centre). This may be because a soundmixing engineer produces such a situation in surround mixing the multichannel loudspeaker mix.

In such embodiments the same loudspeakers $i_l$, $i_r$, and $i_c$ identified earlier are used by the coherence analyser to determine normalized coherence values $c'_{cl}$ and $c'_{cr}$ using the normalized coherence determination discussed earlier. In other words the following values are computed:

$$c'_{cl} = \frac{|c_{cl}|}{\sqrt{|c_{cc}c_{ll}|}}, c'_{cr} = \frac{|c_{cr}|}{\sqrt{|c_{cc}c_{rr}|}}.$$

The coherence analyser 305 may then determine a normalized coherence value $c'_{clr}$ depicting the coherence among these loudspeakers using the following:

$$c'_{clr}=\min(c'_{cl},c'_{cr}).$$

In addition, the coherence analyser may be configured to determine a parameter that depicts how evenly the energy is distributed between the channels $i_l$, $i_r$, and $i_c$, $$\xi_{clr} = \min\left(\frac{E_l}{E_c}, \frac{E_c}{E_l}, \frac{E_r}{E_c}, \frac{E_c}{E_r}\right).$$

Using these variables, the coherence analyser may determine a new coherent panning parameter κ as, $$\kappa=c'_{clr}\xi_{clr}.$$

This coherent panning parameter κ has values between 0 and 1. A value of 1 means that there is coherent sound in all loudspeakers $i_l$, $i_r$, and $i_c$, and the energy of this sound is evenly distributed among these loudspeakers. The reason for this could, for example, be because the loudspeaker mix was generated using studio mixing techniques for creating a perception of a sound source being closer. A value of 0 means that no such technique has been applied, and, for example, the sound may simply be positioned to the closest loudspeaker.

The coherence analyser determined stereoness parameter μ which measures the amount of coherent sound in $i_l$ and $i_r$ (but not in $i_c$), and coherent panning parameter κ which measures the amount of coherent sound in all $i_l$, $i_r$, and $i_c$ is configured to use these to determine coherence parameters to be output as metadata.

Thus the coherence analyser is configured to combine the stereoness parameter μ and coherent panning parameter κ to form a spread coherence ζ parameter, which has values from 0 to 1. A spread coherence ζ value of 0 denotes a point source, in other words, the sound should be reproduced with as few loudspeakers as possible (e.g., using only the loudspeaker $i_c$). As the value of the spread coherence ζ increases, more energy is spread to the loudspeakers around the loudspeaker $i_c$; until at the value 0.5, the energy is evenly spread among the loudspeakers $i_l$, $i_r$, and $i_c$. As the value of spread coherence ζ increases over 0.5, the energy in the loudspeaker $i_c$ is decreased; until at the value 1, there is no energy in the loudspeaker $i_c$, and all the energy is at loudspeakers $i_l$ and $i_r$.

Using the aforementioned parameters μ and κ, the coherence analyser is configured in some embodiments to determine a spread coherence parameter ζ, using the following expression:

$$\zeta = \begin{cases} \max(0.5, \mu - \kappa + 0.5), & \text{if } \max(\mu, \kappa) > 0.5 \ \& \ \kappa > \mu \\ \max(\mu, \kappa), & \text{else} \end{cases}.$$

The above expression is an example only and it should be noted that the coherence analyser may estimate the spread coherence parameter ζ in any other way as long as it complies with the above definition of the parameter.

As well as being configured to detect the earlier situations the coherence analyser may be configured to detect, or at least identify, the situation where the sound is reproduced coherently from all (or nearly all) loudspeakers for creating an "inside-the-head" or "above" perception.

In some embodiments coherence analyser may be configured to sort, the energies $E_i$, and the loudspeaker channel $i_e$ with the largest value determined.

The coherence analyser may then be configured to determine the normalized coherence $c'_{ij}$ between this channel and M other loudest channels. These normalized coherence $c'_{ij}$ values between this channel and M other loudest channels may then be monitored. In some embodiments M may be N−1, which would mean monitoring the coherence between the loudest and all the other loudspeaker channels. However in some embodiments M may be a smaller number, e.g., N−2. Using these normalized coherence values, the coherence analyser may be configured to determine a surrounding coherence parameter γ using the following expression:

$$\gamma = \min_{M}(c'_{i_e j}),$$

where $c'_{i_e j}$ are the normalized coherences between the loudest channel and M next loudest channels.

The surrounding coherence parameter γ has values from 0 to 1. A value of 1 means that there is coherence between all (or nearly all) loudspeaker channels. A value of 0 means that there is no coherence between all (or even nearly all) loudspeaker channels.

The above expression is only one example of an estimate for a surrounding coherence parameter γ, and any other way can be used, as long as it complies with the above definition of the parameter.

The coherence analyser may as discussed above be used to estimate the surrounding coherence and spread coherence parameters. However in some embodiments and in order to improve the audio quality the coherence analyser may, having determined that the situations 1 (the sound is coherently using two loudspeakers for creating an "airy" perception and using front left and right instead of centre) and/or 2 (the sound is coherently using three (or more) loudspeakers for creating a "close" perception) occur within the loudspeaker signals, modify the ratio parameter r. Hence, in some embodiments the spread coherence and surrounding coherence parameters can also be used to modify the ratio parameter r.

As indicated above the energy ratio r is determined as a ratio between the energy of a point source at direction (which may be azimuth θ and/or elevation φ), and the rest of the energy. If the sound source is produced as a point source in the surround mix (e.g., the sound is only in one loudspeaker), the direction analysis correctly produces the energy ratio of 1, and the synthesis stage will reproduce this sound as a point source. However, if audio mixing methods with coherent sound in multiple loudspeakers have been applied (such as the aforementioned cases 1 and 2), the direction analysis will produce lower energy ratios (as the sound is not a point source anymore). As a result, the synthesis stage will reproduce part of this sound as ambient, which may lead, for example, to a perception of faraway sound source contrary of the aim of the studio mixing engineer when generating the loudspeaker mix.

Thus in some embodiments the coherence analyser may be configured to modify the energy ratio if it is detected that audio mixing techniques have been used that distribute the sound coherently to multiple loudspeakers.

Thus in some embodiments the coherence analyser is configured to determine a ratio between the energy of loudspeakers $i_l$ and $i_r$ and all the loudspeakers, $$\xi_{lr/all} = \frac{E_l + E_r}{\sum E_i}.$$

Using this ratio, and the $c'_{lr}$ and γ as determined above, an alternative energy ratio $r_s$ is generated by the coherence analyser, $$r_s = c'_{lr}\xi_{lr/all} - \gamma.$$

In some embodiments the coherence analyser may be similarly configured to determine a ratio between the energy of loudspeakers $i_l$, $i_r$, and $i_c$ and all the loudspeakers, $$\xi_{clr/all} = \frac{E_c + E_l + E_r}{\sum E_i}.$$

Using this ratio, and the $c'_{clr}$ and γ computed above, a further alternative energy ratio $r_c$ is formed by the coherence analyser, $$r_c = c'_{clr}\xi_{clr/all} - 65.$$

Using these energy ratios, the original energy ratio r can be modified by the coherence analyser to be, $$r' = \max(r, r_s, r_c).$$

This modified energy ratio r' can be used to replace the original energy ratio r. As a result, for example, in the situation 1 (the sound is coherently using two loudspeakers for creating an "airy" perception and using front left and right instead of centre), the ratio r' will be close to 1 (and the spread coherence ζ also close to 1). As discussed later in the synthesis phase, the sound will be reproduced coherently from loudspeakers $i_l$ and $i_r$ without any decorrelation. Thus, the perception of the reproduced sound will match the original mix.

With respect to FIGS. 4*a*, 4*b*, 4*c*, and 4*d* are shown flow diagrams summarising the operations described above.

Figure 4A:
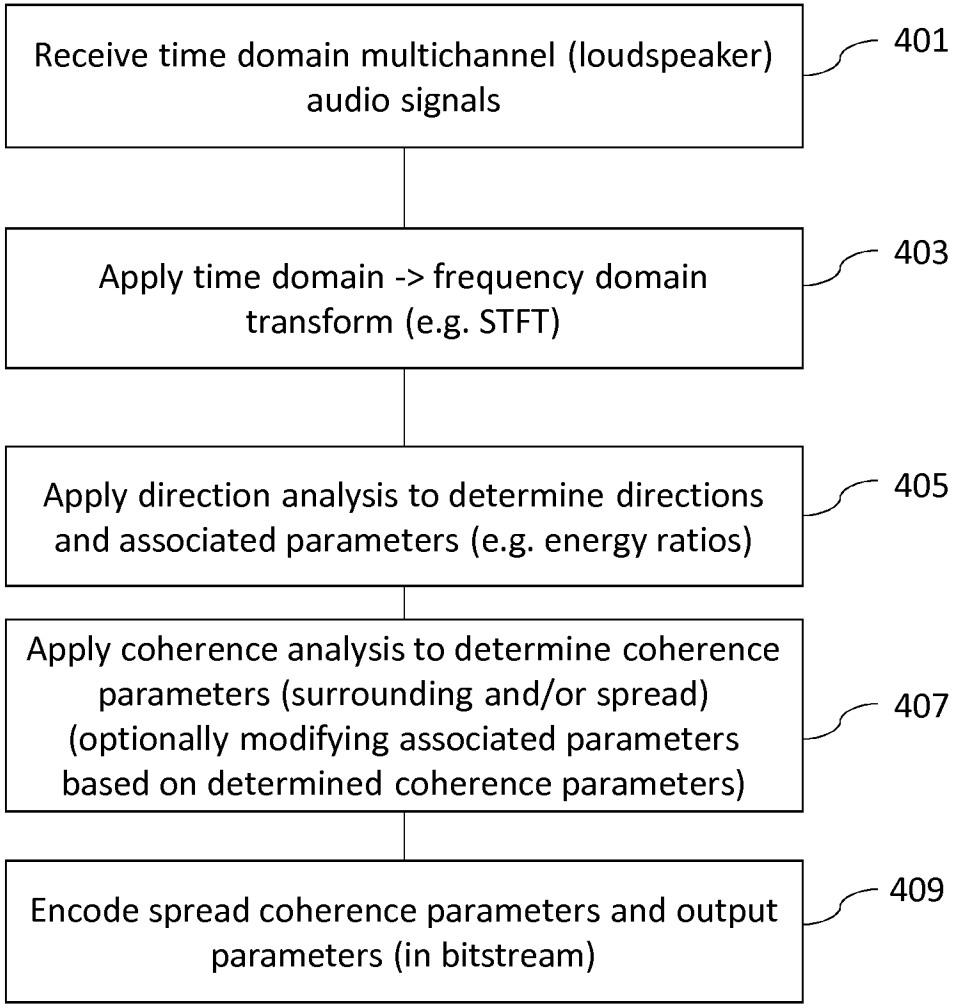

Thus for example FIG. 4*a* shows an example overview of the operation of the analysis processor 105 as shown in FIG. 3.

The first operation is one of receiving time domain multichannel (loudspeaker) audio signals as shown in FIG. 4*a* by step 401.

Following this is applying a time domain to frequency domain transform (e.g. STFT) to generate suitable time-frequency domain signals for analysis as shown in FIG. 4*a* by step 403.

Then applying direction analysis to determine direction and associated parameters (e.g. energy ratio parameters) is shown in FIG. 4*a* by step 405.

Then applying coherence analysis to determine coherence parameters such as surrounding and/or spread coherence parameters is shown in FIG. 4*a* by step 407.

In some embodiments the energy ratio may also be modified based on the determined coherence parameters in this step.

The final operation being one of encoding the spread coherence parameters and outputting the determined parameters, for example within a bit-stream or other suitable data structure is shown in FIG. 4*a* by step 409

With respect to FIG. 4*b* is an example method for generating a spread coherence parameter.

The first operation is computing a covariance matrix as shown in FIG. 4*b* by step 431.

The following operation is determining the channel closest to estimated direction and adjacent channels (i.e. $i_c$, $i_l$, $i_r$) as shown in FIG. 4*b* by step 433.

The next operation is normalising the covariance matrix as shown in FIG. 4*b* by step 435.

The method may then comprise determining energy of the channels using diagonal entries of the covariance matrix as shown in FIG. 4*b* by step 437.

Then the method may comprise determining a normalised coherence value among the left and right channels as shown in FIG. 4*b* by step 439.

The method may comprise generating a ratio between the energies of $i_l$ and $i_r$ channels and $i_l$, $i_r$ and $i_c$ as shown in FIG. 4*b* by step 441.

Then a stereoness parameter may be determined as shown in FIG. 4*b* by step 443.

Also in parallel with steps 439 to 443 the method may comprise determining a normalised coherence value among the channels as shown in FIG. 4*b* by step 438, determining an energy distribution parameter as shown in FIG. 4*b* by step 440 and determining a coherent panning parameter as shown in FIG. 4*b* by step 442.

Finally the operation may determine spread coherence parameter from the stereoness parameter and the coherent panning parameter as shown in FIG. 4*b* by step 445.

Figure 4C:
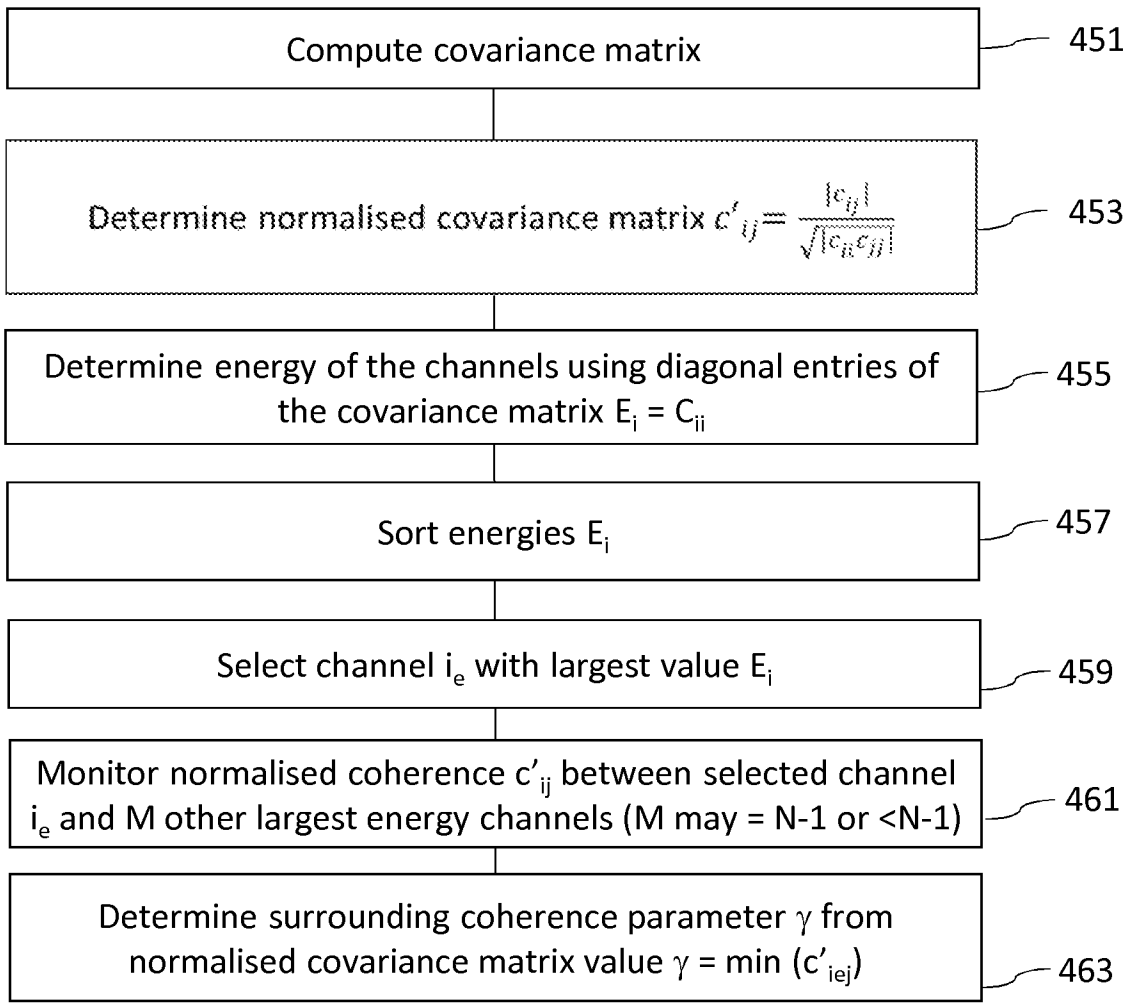

Furthermore FIG. 4*c* shows an example method for generating a surrounding coherence parameter.

The first three operations are the same as three of the first four operations shown in FIG. 4*b* in that first is computing a covariance matrix as shown in FIG. 4*c* by step 451.

The next operation is normalising the covariance matrix as shown in FIG. 4*c* by step 453.

The method may then comprise determining energy of the channels using diagonal entries of the covariance matrix as shown in FIG. 4*c* by step 455.

Then the method may comprise sorting energies $E_i$ as shown in FIG. 4*c* by step 457.

Then the method may comprise selecting channel with largest value as shown in FIG. 4*c* by step 459.

The method may then comprise monitoring a normalised coherence between the selected channel and M other largest energy channels as shown in FIG. 4*c* by step 461.

Then determining surrounding coherence parameter from the normalised covariance matrix values as shown in FIG. 4*c* by step 463.

Figure 4D:
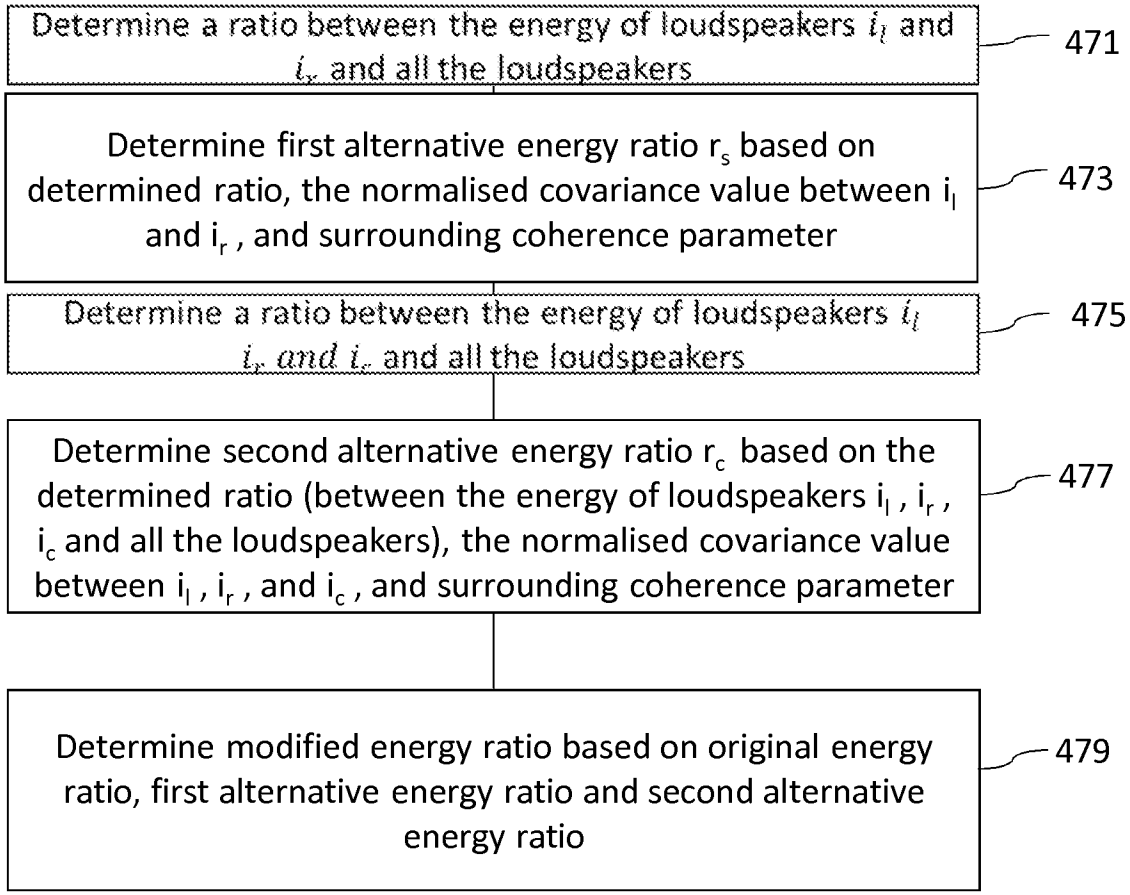

With respect to FIG. 4*d* an example method for modifying the energy ratio is shown.

The first operation is determining a ratio between the energy of loudspeakers $i_l$ and $i_r$ and all the loudspeakers as shown in FIG. 4*d* by step 471.

Then determining a first alternative ratio $r_s$ based on this ratio and the $c'_{lr}$ and γ as determined above, by the coherence analyser is shown in FIG. 4*d* by step 473.

The next operation is determining a ratio between the energy of loudspeakers $i_l$ and $i_r$ and $i_c$ and all the loudspeakers as shown in FIG. 4*d* by step 475.

Then determining a second alternative ratio $r_c$ based on this ratio and the $c'_{clr}$ and γ as determined above, by the coherence analyser is shown in FIG. 4*d* by step 477.

A modified energy ratio may then be determined based on original energy ratio, first alternative energy ratio and second alternative energy ratio, as shown in FIG. 4*d* by step 479 and used to replace the current energy ratio.

The above formulation was detailed to estimate the coherence parameters for surround loudspeaker input. Similar processing can be also performed for audio object input, by treating the audio objects as audio channels at determined positions at each temporal parameter estimation interval.

Furthermore, the coherence parameters such as spread and surround coherence parameters could be estimated also for microphone array signals or Ambisonic input signals. As an example, from some microphone arrays the method and apparatus may obtain first-order Ambisonic (FOA) signals by methods known in the literature. FOA signals consist of an omnidirectional signal and three orthogonally aligned figure-of-eight signals having a positive gain at one direction and a negative gain at another direction. In one example of coherence parameter estimation for such an input, the method and apparatus may monitor the relative energies of the omnidirectional and the three directional signals of the FOA signal. This is since if a sound is reproduced from surrounding directions coherently and a FOA signal is captured, the omnidirectional ($0^{th}$ order FOA) signal consists of a sum of these coherent signals. On the contrary, the three figure-of-eight ($1^{st}$ order FOA) signals have positive and negative gains direction-dependently, and thus the coherent signals will partially or completely cancel each other at these $1^{st}$ order FOA signals. Therefore, the surround coherence parameter could be estimated such that a higher value is provided when the energy of the $0^{th}$ order FOA signal becomes higher with respect to the combined energy of the $1^{st}$ order FOA signals.

Figure 4E:
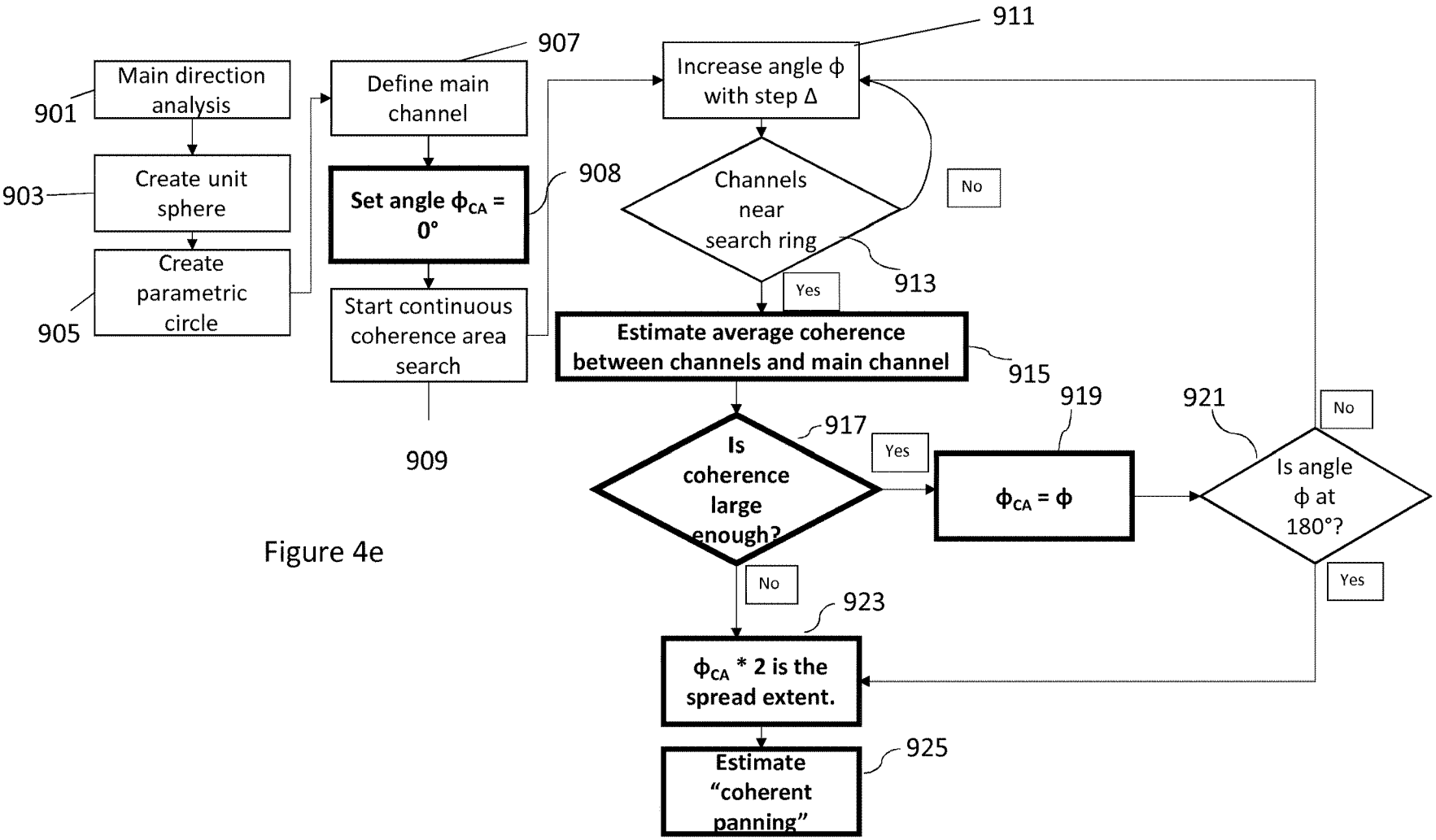

With respect to FIG. 4*e* a further example of determining the spread coherence parameter is shown. In this example the spread coherence estimation method described above is further generalized by using all input channels instead of just using the neighbouring channels.

This may be achieved in some embodiments by implementing a method which searches for a continuous coherent area (and generalizes the situation where multiple loudspeakers are used to reproduce the coherent signal).

In this method a search pattern may be defined with parameter angles (ϕ phi, starting from 0°) and step (Δ delta, e.g., with value of 5°).

The method may perform an initial main direction analysis (or receive from the direction analyser 303) to determine one or more directions as shown in FIG. 4*e* by step 901.

The method may then place input channels on a unit sphere based on their directions (or create a unit sphere) as shown in FIG. 4*e* by step 903.

The method is then further shown creating a circle on the unit sphere with main direction as a centre point and (ϕ) as angle between centre point vector and vector pointing to the edge of circle (or otherwise create a parametric circle) as shown in FIG. 4*e* by step 905.

The main direction can be provided by a suitable means such as the suggested method for direction analysis in the methods above. A main channel may then be selected to be a speaker node or channel closest to the estimated main direction. The definition of the main channel is shown in FIG. 4*e* by step 907.

The next operation is to set an initial coherent angle is defined, for example $\phi_{CA}=0$ as shown in FIG. 4*e* by step 908.

A coherence area search is then started. This search uses the main channel with a search region ϕ as shown in FIG. 4*e* by step 909.

The next operation is to increase the angle ϕ using the step Δ as shown in FIG. 4*e* by step 911. If ϕ would be over 180 degrees, it is set to 180 degrees.

Figure 10:
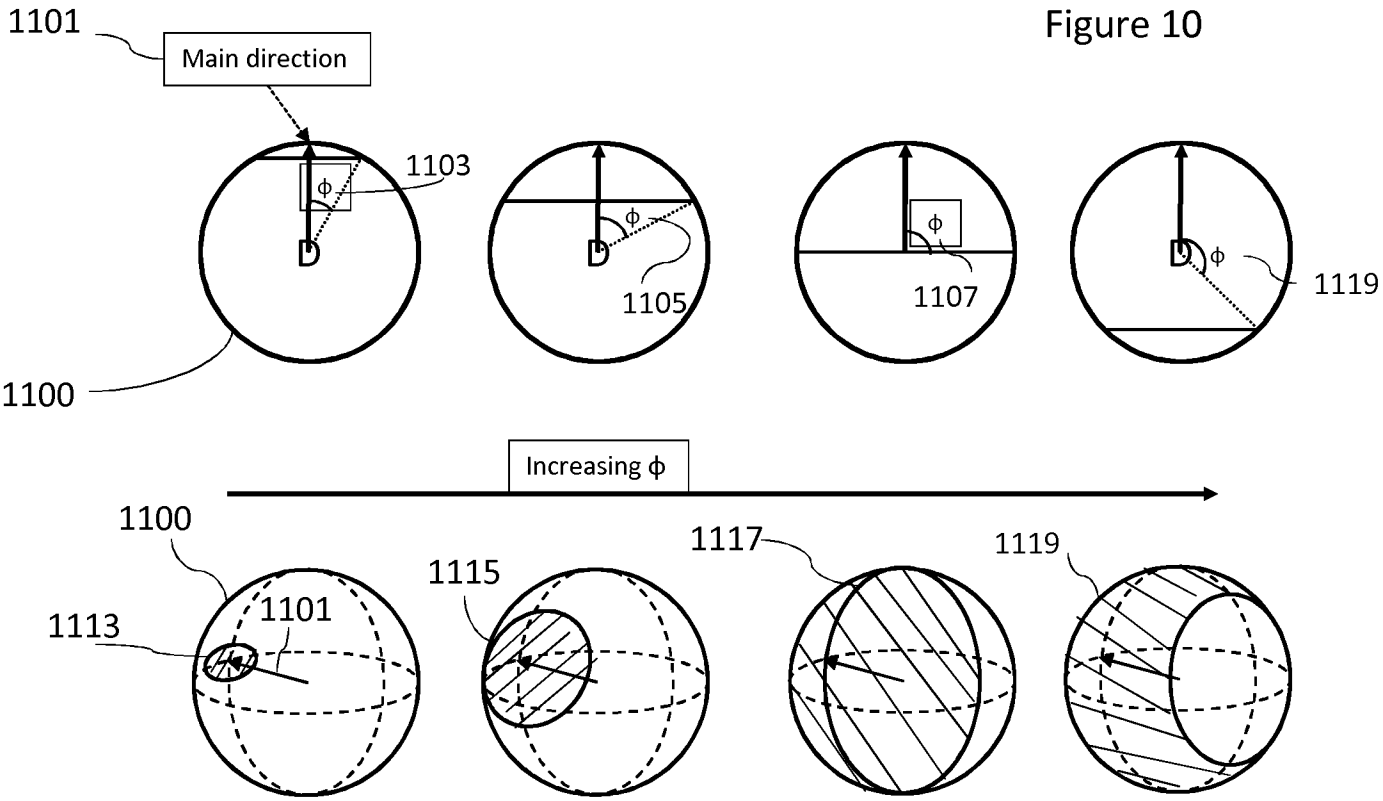
FIG. 10 shows example increasing ring/areas for the determination of the coherence parameter.

This for example is shown in FIG. 10 wherein for the unit sphere 1100 is shown the main direction 1101 and the first angle ϕ1103 and which defines a first search ring 1113 on the surface of the sphere. As shown in FIG. 10 the angle ϕ may be increased in further iterations by the step Δ. As shown in FIG. 10 the angle can be increased to a second angle 1105, a third angle 1107 and fourth angle 1119 which produces the second ring 1115, a third ring 1117 and fourth ring 1119.

With this search region defined by the direction and angle there is a check to whether there are any input channels within the search ring (within a defined tolerance) as shown in FIG. 4*e* by step 913.

Where there are no input channels then the method passes back to step 911 and the search ring is increased by increasing the angle ϕ further by the step Δ.

For any determined input channels within the search ring the normalised coherent energy between the detected channels and the main channel is calculated, and an average of them is calculated as shown in FIG. 4*e* by step 915.

A check is then made to determine whether the average coherence is above a determined tolerance (e.g., over 0.5). The check is shown in FIG. 4*e* by step 917.

Where the check determines the average coherence is above a determined tolerance then the coherent angle $\phi_{CA}$ is increased to the current angle, in other words $\phi_{CA}=\phi$.

In other words the newly determined channels are added to the area. This is shown in FIG. 4*e* by step 919.

Then a further check is made to determine whether the search angle ϕ is 180 degrees as shown in FIG. 4*e* by step 921.

Where the search angle is less than 180 degrees the operation passes back to step 911 and the search ring is increased by increasing the angle ϕ further by the step Δ.

Where the coherence energy does not match (or where the angle is 180 degrees) then $\phi_{CA}*2$ is set as the spread extent as shown in FIG. 4*e* by step 923.

The following operation after setting $\phi_{CA}*2$ as the spread extent is to estimate a coherent panning parameter as shown in FIG. 4*e* by step 925.

To estimate a coherent panning parameter first the loudspeaker a closest to the analysed direction is determined. Next, the normalized coherence $c_{a,i}$ between that channel a and all channels i where i≠a inside the area is determined. Next, channels with energy below a threshold energy (e.g., $E_\tau=0.01E_c$) are omitted, and the minimum coherence from the remaining is selected $$c_{area}=\min(c_{a,i}), i \in \text{area}, i \neq a, i \neq \text{omittedchannel}$$

Next, $\xi_{area}$ is determined that indicates how evenly the energy is distributed among these channels $$\xi_i = \min\left(\frac{E_c}{E_i}, \frac{E_i}{E_c}\right)$$

$$\xi_{area} = \min(\xi_i), i \in \text{area}, i \neq c, i \neq omittedchannel$$

Using these variables, the coherent panning parameter can be formed $$\kappa=c_{area}\xi_{area}$$

as shown in FIG. 4*e* by step 925.

Figure 4F:
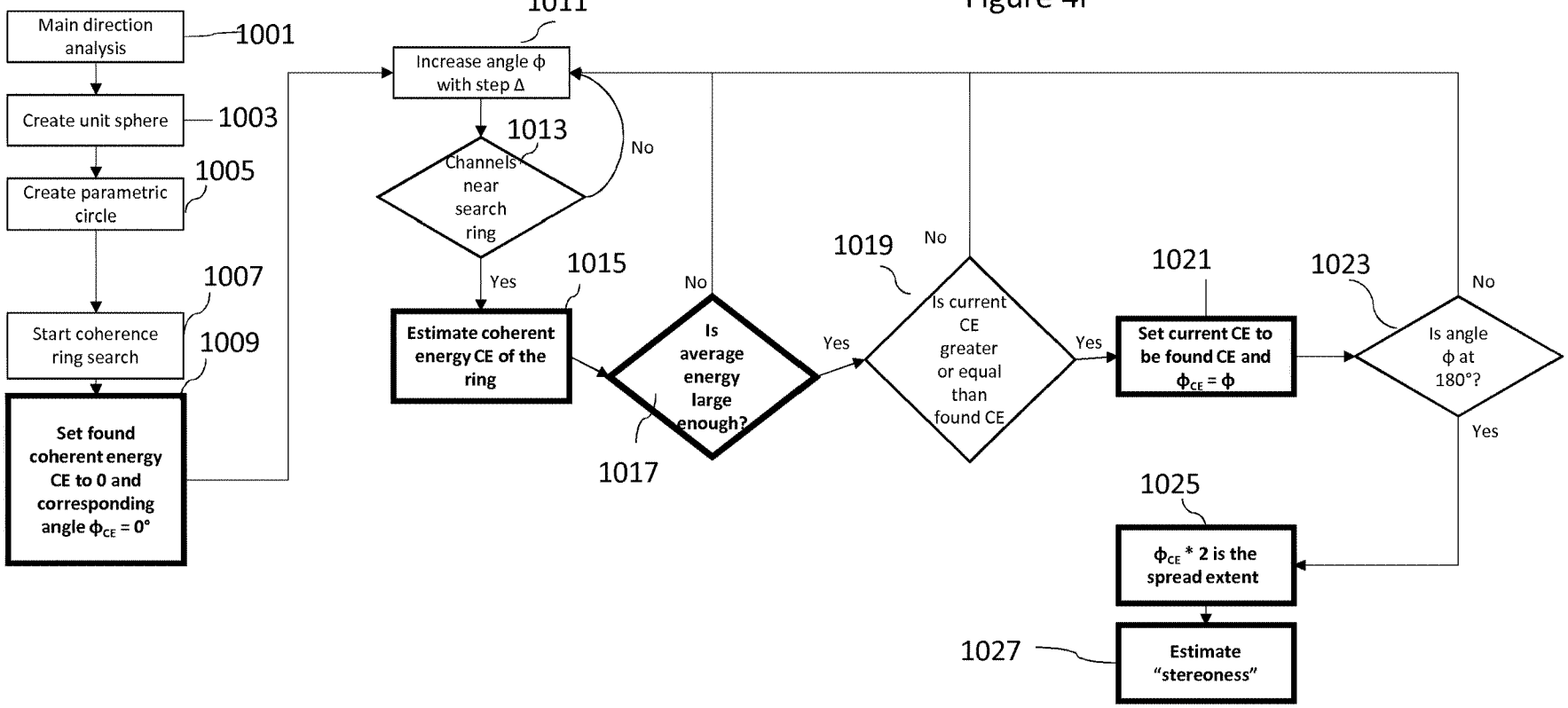

With respect to FIG. 4*f* a further embodiment is shown.

This further embodiment generalizes a search for a coherent edge and is shown by a search for a coherent ring.

The method may perform an initial main direction analysis (or receive from the direction analyser 303) to determine one or more directions as shown in FIG. 4*f* by step 1001.

The method may then place input channels on a unit sphere based on their directions (or create a unit sphere) as shown in FIG. 4*f* by step 1003.

The method is then further shown creating a circle on the unit sphere with main direction as a centre point and (ϕ) as angle between centre point vector and vector pointing to the edge of circle (or otherwise create a parametric circle) as shown in FIG. 4*f* by step 1005.

A coherence area search is then started. This search uses the main channel with an angle ϕ=0 as shown in FIG. 4*f* by step 1007. In this method a search pattern may be defined with parameter angles (ϕ starting from 0°) and step (Δ delta, e.g., with value of (5°).

Furthermore a found coherence energy CE value is set to 0 and a coherence angle $\phi_{CE}=0$ defined as shown in FIG. 4*f* by step 1009.

The next operation is to increase the search angle ϕ using the step Δ as shown in FIG. 4*f* by step 1011. If ϕ would be over 180 degrees, it is set to 180 degrees.

With this direction and angle there is a check to whether there are any input channels near the search ring (within a determined tolerance for example 10 degrees) as shown in FIG. 4*f* by step 1013.

Where there are no input channels near the ring then the method passes back to step 1011 and the search ring is increased by increasing the angle ϕ further by the step Δ.

When there are at least two input channels on the search ring (within the tolerance) then the coherence between all channels on the ring is determined and an average coherence of the ring determined.

Also an average energy for all channels on the ring is determined.

The determined average coherence and average energy are then multiplied to generate a coherent energy CE of the ring as shown in FIG. 4*f* by step 1015.

A check is then made to determine whether the average energy is large enough as shown in FIG. 4*f* by step 1017.

Where the average energy is not larger than a minimum value than the next step is 1011, and the ring size is increased and input channels near the ring searched for again.

Where the average energy of the ring is larger than a minimum value (e.g., 0.1) and a further check is performed to compare the determined coherent energy CE of the ring to the previous ring's coherent energy. The CE check is shown in FIG. 4*f* by step 1019.

Where the check determines the coherent energy of the ring is larger than the coherent energy of the previous ring, then use this ring as the coherence ring. In other words set the found CE to the determined CE value for the ring and $\phi_{CE}=\phi$ as shown in FIG. 4*f* by step 1021.

Where the coherent energy of the ring is less than the coherent energy of the previous ring then the operation passes back to step 1011 and the search ring is increased by increasing the angle $\phi$ further by the step $\Delta$.

Where the coherent energy is larger, then a further check is made to determine whether the search angle $\phi$ is 180 degrees as shown in FIG. 4*f* by step 1023.

Where the search angle is less than 180 degrees then the operation passes back to step 1011 and the search ring is increased by increasing the angle $\phi$ further by the step $\Delta$.

Where the search angle is 180 degrees then the spread extent is set as $\phi_{CE}*2$ as shown in FIG. 4*f* by step 1025.

The following operation after setting the spread extent at $\phi_{CE}*2$ is to estimate a stereoness parameter as shown in FIG. 4*f* by step 1027. The stereoness parameter may be determined by first, find a channel m on the ring that has the most energy $E_m$. Then, compute normalized coherences $c_{m,i}$ between this channel and other channels i on the ring. Next, compute a mean of these coherences weighted by the respective energies $$c_{ring} = \frac{\sum_{i \in ring, i \neq m} c_{m,i} E_i}{\sum_{i \in ring, i \neq m} E_i}$$

Then, compute a ratio of energies on the ring and inside the ring $$\xi_{ring} = \frac{\sum_{i \in ring} E_i}{\sum_{i \in surfaceinsidering} E_i}$$

Using these variables, a stereoness parameter can be formed $$\mu = c_{ring} \xi_{ring}$$

Having determined a coherent panning and stereoness parameter they can be combined similarly as presented above to form the combined spread coherence parameter.

As the examples above also generate a spread extent parameter they may in some embodiments be combined. In some embodiments this combination may be to select the larger spread extent of the two results.

The above algorithm shows an example of a generic search pattern using a circle. However, the method is not limited into these and various shapes and forms could be used instead of a circle. Additionally, it is not mandatory to use 3D search and we could search using just 2D pattern and include rotations of this 2D pattern.

These (modified) energy ratios 110, surrounding coherence 112 and spread coherence 114 parameters may then be output. Furthermore as discussed the spread coherence parameters may be passed to a metadata combiner or be processed in any suitable manner, for example encoding and/or multiplexing with the downmix signals and stored and/or transmitted (and be passed to the synthesis part of the system). The synthesis method may be a modified least-squares optimized signal mixing technique to manipulate the covariance matrix of a signal, while attempting to preserve audio quality. The method utilizes the covariance matrix measure of the input signal and a target covariance matrix (as discussed below), and provides a mixing matrix to perform such processing. The method also provides means to optimally utilize decorrelated sound when there is no sufficient amount of independent signal energy at the inputs.

Figure 5B:
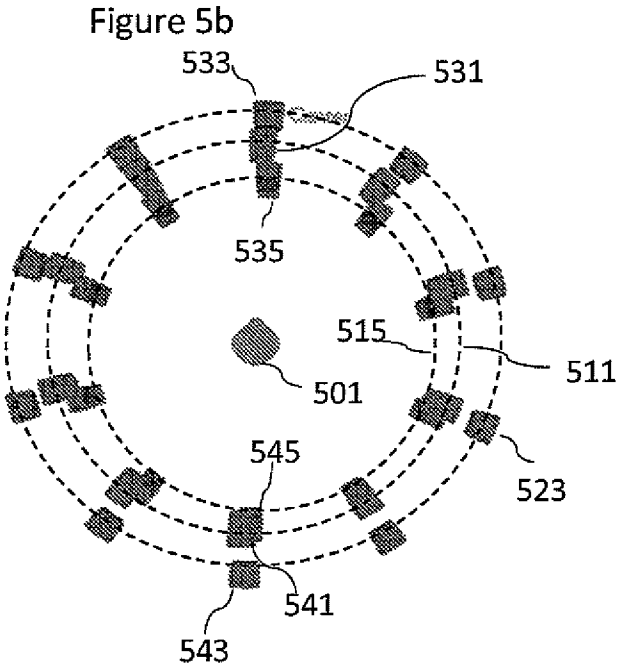
FIGS. 5*a* and 5*b* show an example virtual speaker node arrangement suitable for application of some embodiments.
Figure 5A:
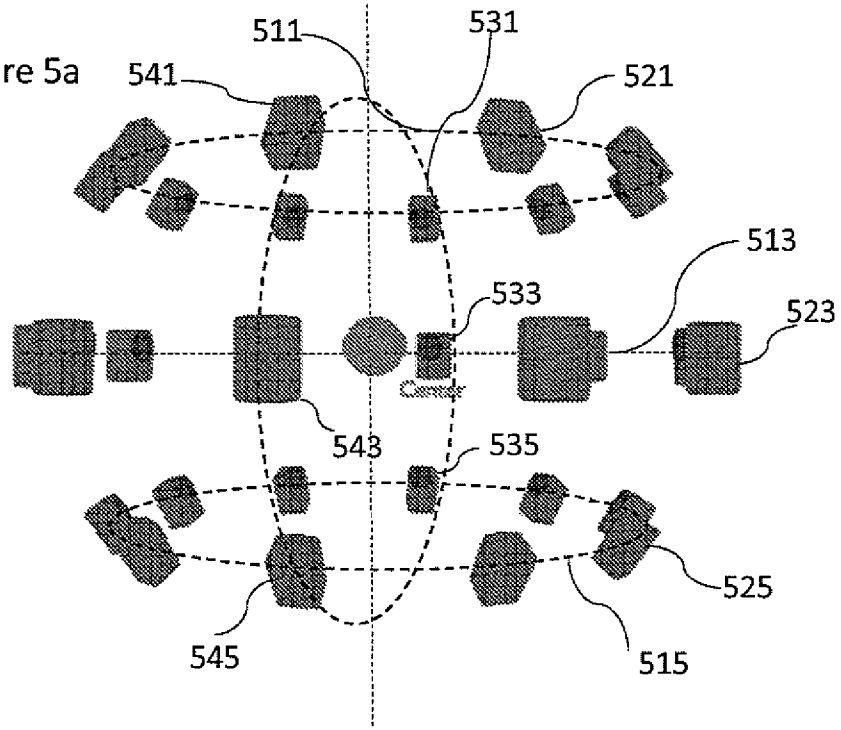

Before further discussing the generation and encoding of coherence parameters example speaker node arrangements are discusses. With respect to FIGS. 5*a* and 5*b* show a first view and a plan view respectively of an example immersive audio presentation arrangement. The array shown in FIGS. 5*a* and 5*b* show 30 speaker nodes which may represent (virtual) loudspeakers. In this example the array is arranged with three rings, each ring comprising 10 speaker nodes.

A first ring 513 is a horizontal ring at the ear level around the listening position 501 with a front centre speaker 533 (on the reference azimuth which is 'directly' in front of the listening position 501), a rear centre speaker 543 (on the opposite side to the reference azimuth and is 'directly' to the rear of the listening position 501) and one further speaker 523 labelled.

The array may further comprise a first elevated or higher ring 511, which is a horizontal ring above the ear level around the listening position 501 with a front centre speaker 531 (on the reference azimuth which is 'directly' in front of the listening position 501), a rear centre speaker 541 (on the opposite side to the reference azimuth and is 'directly' to the rear of the listening position 501) and one further speaker 521 labelled.

The array is further shown comprising a depressed or lower ring 515 which is a horizontal ring below the ear level around the listening position 501 with a centre speaker 535 (on the reference azimuth which is 'directly' in front of the listening position 501), a rear centre speaker 545 (on the opposite side to the reference azimuth and is 'directly' to the rear of the listening position 501) and one further speaker 525 labelled.

A (virtual) speaker node array can in some embodiments alternatively surround the listening position fully (i.e., there can be for example virtual loudspeakers around the user in an equidistant array configuration) thus giving the user full freedom of 3DoF rotation without loss of resolution due to selected viewing/listening direction.

The spacing between speaker nodes may vary greatly depending on the 'viewing' direction and may not be equidistant in azimuth distribution as shown in FIGS. 5*a* and 5*b*. For example, traditional horizontal loudspeaker configurations such as 5.1 or 7.1 provide a higher spatial resolution in front of the user than in other directions. Furthermore in some embodiments the speaker distribution is may be configure to provide higher rings and not provide lower rings or provide more than one higher or lower rings.

Thus although the following examples are described with respect to this example speaker node distribution the embodiments as described hereafter may be applied to any suitable speaker node distribution.

Figures 6A, 6B:
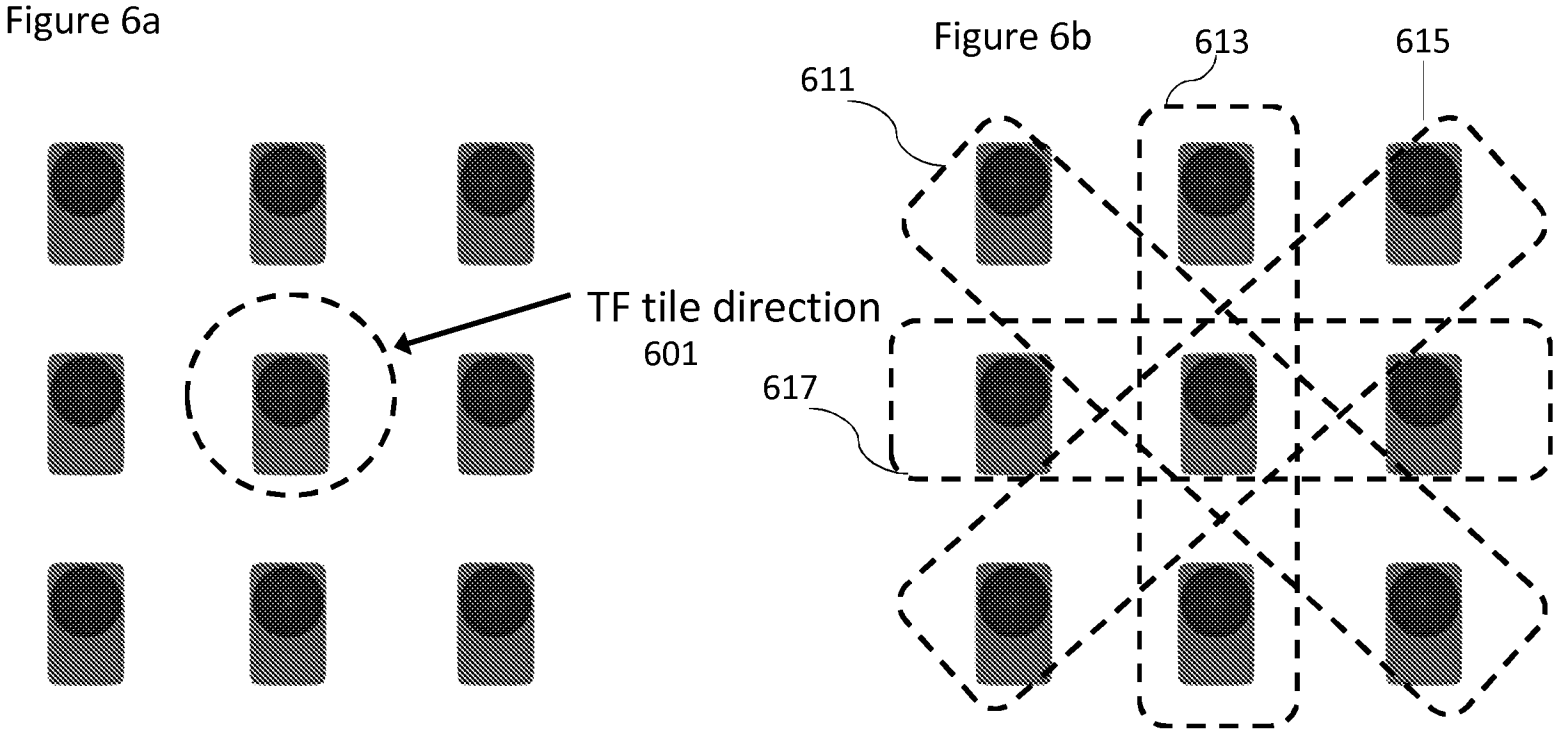
FIGS. 6*a* and 6*b* show example coherence in arrays of speaker nodes.

With respect to FIGS. 6*a* and 6*b* is shown an example wherein considering only the closest adjacent directions (or speaker nodes) for coherence evaluation and the signalling/transmission of the coherence parameters creates a large amount of data. Thus for example for a single speaker node 601 there is to be considered at least four orientations shown as vertical orientation 613, horizontal orientation 617, first diagonal orientation 611 and second diagonal orientation 615. Thus when a single dominant coherence component is transmitted, the signalling still requires a selected or chosen orientation to be signalled.

A coherent reproduction orientation parameter can be estimated once we know the coherent reproduction extent. This parameter is used to support reproduction when a circle reproduction is not assumed. A method to find the orientation parameter is to estimate the spread coherence parameter (and the forming "stereoness" and "coherent panning" parameters) for each orientation angle using always the main direction loudspeaker and the nearest loudspeakers in positive and negative extent angle (i.e., ±extent/2) in the rotated plane. The orientation that obtains the largest spread coherence parameter is the chosen orientation angle. If multiple angles use the same "left" and "right" loudspeakers, the mean of these angles is used. This further assumes that the search for the orientation angles goes from −90° to 90° in certain steps (e.g., 10°).

Figure 7B:
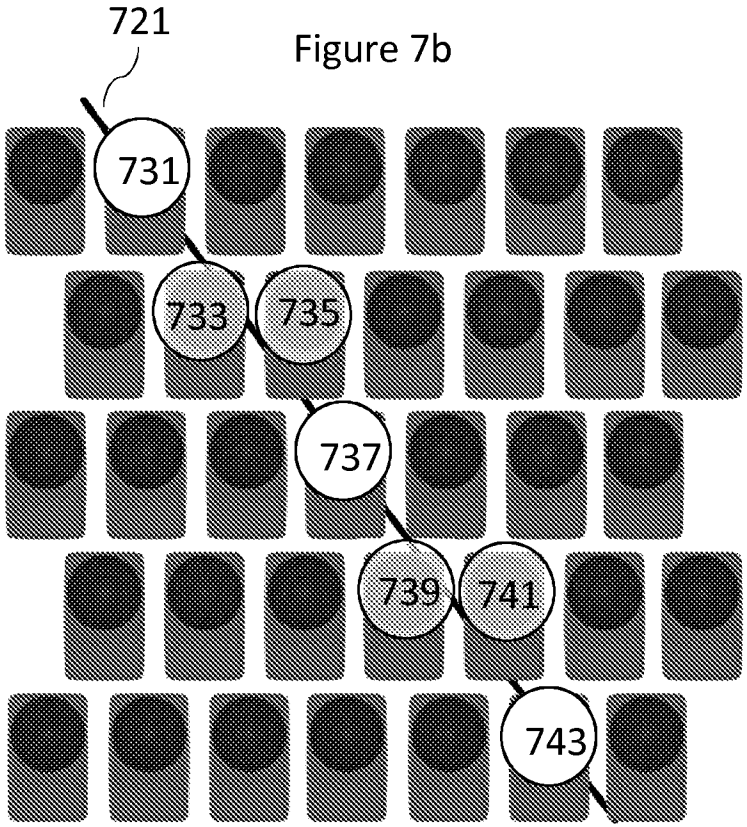
FIGS. 7*a* and 7*b* show example virtual speaker arrays.
Figure 7A:
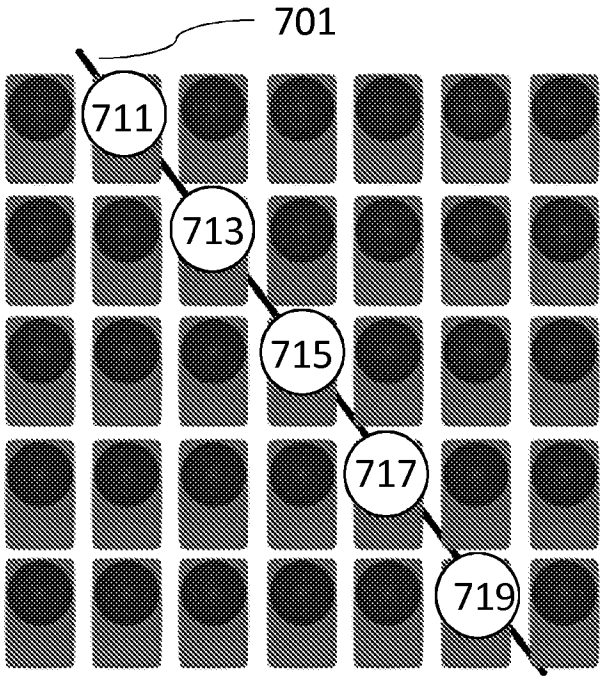

Furthermore as shown in FIGS. 7*a* and 7*b* an orientation in a large array may appear ambiguous depending on the 'centre' or the orientation, the orientation angle and the array configuration. Thus for example FIG. 7*a* shows a first orientation which shows no speaker node ambiguity as the orientation 701 passes through speaker nodes 711, 713, 715, 717, and 719. However FIG. 7*b* shows an orientation 721 where the orientation passes through some speaker nodes 731, 737, and 743 but is ambiguous with respect to speaker nodes pairs 733 and 735, and also 739 and 741. This may not be perceptually relevant and may not impact the encoding and signalling.

In the embodiments described hereafter in addition to the coherence parameter value ('Spread coherence'), the orientation and the circular sector of the coherence is defined. In some embodiments, a spherical sector can be used instead or in addition. In some embodiments the definition may also include an orientation information (and a further descriptor for example a flatness).

It is noted that in some embodiments where complex shapes for the 'Spread coherence' direction are considered the output may require a very large amount of metadata that produces data rates which may be unsuitable particularly for a low-bit-rate codec without a corresponding perceptual advantage. Therefore in some embodiments the perceptually important aspects are defined and encoded in the spatial metadata.

The spread coherence encoder may as discussed previously therefore be caused to encode the spread coherences area orientation and extent:

Spread orientation code with a 0-180 degree rotation, and

Circular sector code with a 0-360 degree central angle for the spread extent

It is noted that the perceptual effect of the spread coherence parameter on the reproduction is limited if the circular sector is very small. At small values, the source remains more point-like. On the other hand, small changes of orientation angle are generally also perceptually insignificant at small sector values.

Figure 8A:
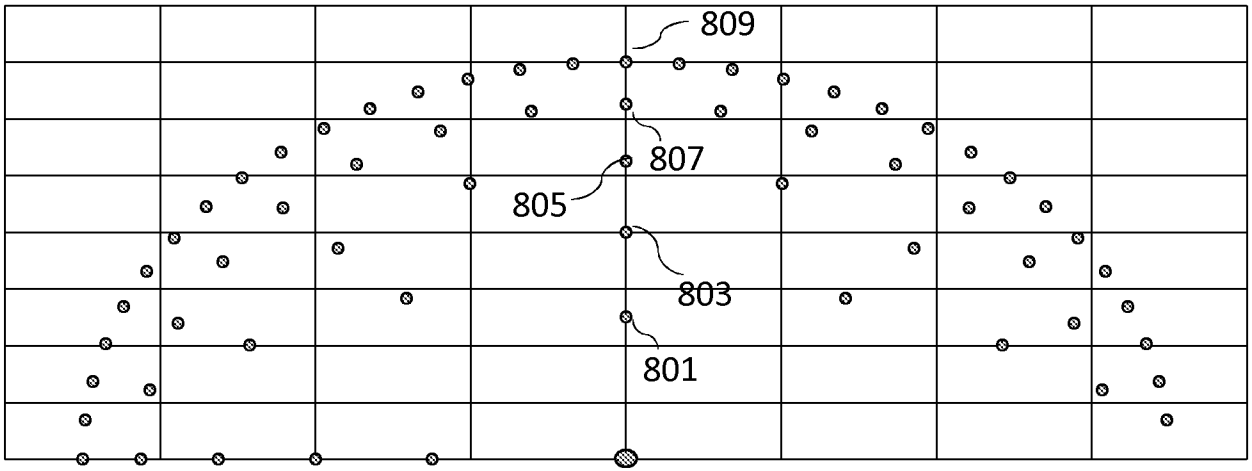
FIGS. 8*a* and 8*b* show example spread coherence orientation encoding quantization examples according to some embodiments.
Figure 8B:
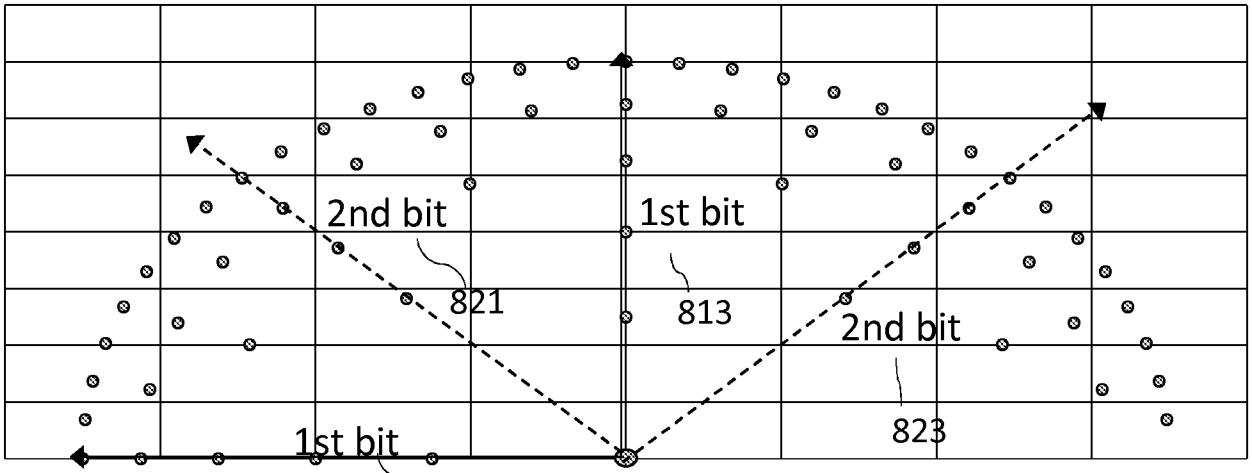

With respect to FIGS. 8*a* and 8*b* are shown an example orientation coding which has the form:

$$\Sigma b_i Q_{step}^{\ i}$$

where b is the signalling bit and $Q_{step}$ is the quantization step size. For a 4-bit description this would be:

$$b_3 Q_{step}^{\ 3} + b_2 Q_{step}^{\ 2} + b_1 Q_{step}^{\ 1} + b_0 Q_{step}^{\ 0}.$$

Thus as shown in FIG. 8*a* are the example quantization points for a 1 bit quantization 801 (either at −pi/2 or 0), 2 bits quantization 803 (at −2pi/4, −pi/4, 0 or +pi/4), 3 bits quantization 805 (−4pi/8, −3pi/8, −2pi/8, −pi/8, 0, +pi/8, 2pi/8, 3pi/8), 4 bits quantization 807 (from −8pi/16 to 7pi/16 in pi/16 steps) and 5 bits quantization 809 (from −15pi/32 to 14pi/32 in pi/32 steps).

Furthermore FIG. 8*b* shows the directions associated with the first bit $b_0$ which defines whether the direction is −pi/2 where $b_0$=0 and 0 where $b_0$=1 and the effect when the second bit $b_1$ is 1. For example −pi/4 when $b_0b_1$=01 and pi/4 when $b_0b_1$=11.

FIG. 9*a* furthermore shows a table summarizing an example 4-bit embedded code (where a base offset of −90 degrees is added to correspond with FIGS. 8*a* and 8*b*).

In some embodiments, the orientation code can be embedded, in which case the orientation accuracy can be decreased by dropping bits in the encoder. In an embedded code, a baseline description provides the rough orientation (e.g., 90-degree or 45-degree accuracy) and extra bit layer defines a more accurate orientation.

FIG. 9*b* shows a further table which indicates an embedded example code with a 2-bit baseline and two 1-bit embedded fields (with example values of 15 and 7.5 degrees each). A normalization is carried out to place all values between −90 and 89.99 degrees, as any orientation offset by 180 degrees corresponds to one without the offset for the orientation data.

The (circular) sector extent can be encoded by the implementation of a scalar quantized value. In some embodiments the quantization may correspond to a virtual loudspeaker array which is to be used as the intended rendering speaker node array or in some embodiments it may be an "arbitrary" quantizer.

In some embodiments, the input channel configuration is signalled to the decoder. In such case, the (circular) sector extent (as well as the orientation code) can directly utilize this information to maintain a quantization that corresponds with the input.

Figure 11:
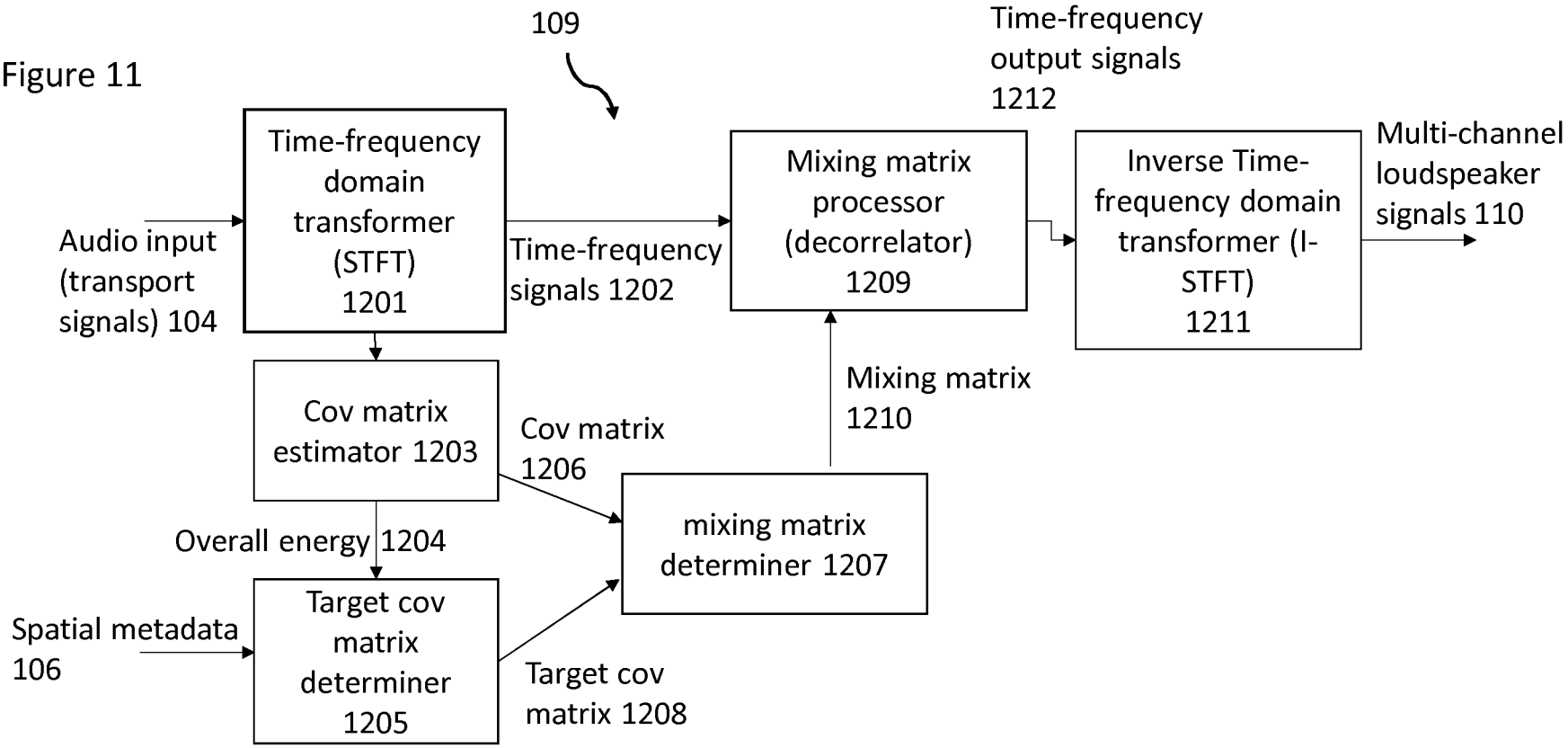
FIG. 11 shows schematically the synthesis processor as shown in FIG. 1 according to some embodiments.

With respect to FIG. 11, an example synthesis processor 109 is shown in further detail. The example synthesis processor 109 may be configured to utilize a modified method such as detailed in: US20140233762A1 *"Optimal mixing matrices and usage of decorrelators in spatial audio processing"*, Vilkamo, Bäckström, Kuntz, Küch.

The cited method may be selected for the reason that it is particularly suited for such cases where the inter-channel signal coherences require to be synthesized or manipulated.

A synthesis processor 109 may receive the transport signals 104 and the metadata 106.

The synthesis processor 109 may comprise a time-frequency domain transformer 301 configured to receive the transport signals 104 and apply a suitable time to frequency domain transform such as a Short Time Fourier Transform (STFT) in order to convert the input time domain signals into a suitable time-frequency signals. These time-frequency signals, the time-frequency signals may be passed to a mixing matrix processor 1209 and covariance matrix estimator 1203.

The time-frequency signals may then be processed adaptively in frequency bands with a mixing matrix processor (and potentially also decorrelation processor) 1209, and the result in the form of time-frequency output signals 1212 is transformed back to the time domain to provide the processed output in the form of spatialized audio signals 1214. The mixing matrix processing methods are well documented, for example in Vilkamo, Bäckström, and Kuntz. *"Optimized covariance domain framework for time-frequency processing of spatial audio." Journal of the Audio Engineering Society* 61.6 (2013): 403-411.

To apply the mixing matrix processing, a mixing matrix 1210 in frequency bands is required. The mixing matrix 1210 may in some embodiments be formulated within a mixing matrix determiner 1207. The mixing matrix determiner 1207 is configured to receive input covariance matrices 1206 in frequency bands and target covariance matrices 1208 in frequency bands.

The covariance matrices 1206 in frequency bands is simply determined in the covariance matrix estimator 1203 and measured from the downmix signals in frequency bands from the time-frequency domain transformer 1201.

The target covariance matrix is formulated in some embodiments in a target covariance matrix determiner 1205.

The target covariance matrix determiner 1205 in some embodiments is configured to determine the target covariance matrix for reproduction to surround loudspeaker setups. In the following expressions the time and frequency indices n and k are removed for simplicity (when not necessary).

First the target covariance matrix determiner 1205 may be configured to estimate the overall energy E 1204 of the target covariance matrix based on the input covariance matrix from the covariance matrix estimator 1203. The overall energy E may in some embodiments may be determined from the sum of the diagonal elements of the input covariance matrix.

The target covariance matrix determiner 1205 may then be configured to determine the target covariance matrix $C_T$ in mutually incoherent parts, the directional part $C_D$ and the ambient or non-directional part $C_A$.

The target covariance matrix is thus determined by the target covariance matrix determiner 1205 as $C_T=C_D+C_A$.

The ambient part $C_A$ expresses the spatially surrounding sound energy, which previously has been only incoherent, but due to the present invention it may be incoherent or coherent, or partially coherent.

The target covariance matrix determiner 1205 may thus be configured to determine the ambience energy as $(1-r)E$, where r is the direct-to-total energy ratio parameter from the input metadata. Then, the ambience covariance matrix can be determined by, $$C_A = (1-r)E\frac{((1-\gamma)I_{M\times M} + \gamma U_{M\times M})}{M},$$

where I is an identity matrix and U is a matrix of ones, and M is the number of output channels. In other words, when $\gamma$ is zero, then the ambience covariance matrix $C_A$ is diagonal, and when $\gamma$ is one, then the ambience covariance matrix is such that determines that all channel pairs to be coherent.

The target covariance matrix determiner 1205 may next be configured to determine the direct part covariance matrix $C_D$.

The target covariance matrix determiner 1205 can thus be configured to determine the direct part energy as rE.

Then the target covariance matrix determiner 1205 is configured to determine a gain vector for the loudspeaker signals based on the metadata. First, the target covariance matrix determiner 1205 is configured to determine a vector of the amplitude panning gains for the loudspeaker setup and the direction information of the spatial metadata, for example, using the vector base amplitude panning (VBAP). These gains can be denoted in a column vector $v_{VBAP}$, which for a horizontal setup has in maximum only two non-zero values for the two loudspeakers active in the amplitude panning. The target covariance matrix determiner 1205 can in some embodiments be configured to determine the VBAP covariance matrix as, $$C_{VBAP}=v_{VBAP}v_{VBAP}^H.$$

The target covariance matrix determiner 1205 can be configured to determine the channel triplet $i_l$, $i_r$, $i_c$, where $i_c$ the is the loudspeaker nearest to the estimated direction, and the left and right loudspeakers $i_l$, $i_r$, are determined as follows. First, the spread extent is determined, either as a parameter input from the encoder/analysis side, or if not available determined by a constant, for example 60 degrees. Two new directions are formulated by adjusting the azimuth of the direction parameter to the left and to the right by half of the spread extent parameter. The left and right loudspeakers $i_l$, $i_r$, are the nearest loudspeakers to these new directions, with a condition that $i_r \neq i_l \neq i_c$.

In some embodiments when orientation angle is provided, the left and right loudspeakers $i_l$ and $i_r$ are selected to be the nearest loudspeakers in a rotated plane instead of the horizontal plane where plane rotation is defined by the orientation parameter.

The target covariance matrix determiner 1205 may furthermore be configured to determine a panning column vector $v_{LRC}$ being otherwise zero, but having values $\sqrt{1/3}$ at the indices $i_l$, $i_r$, $i_c$. The covariance matrix for that vector is $$C_{LRC}=v_{LRC}v_{LRC}^H.$$

When the spread coherence parameter $\zeta$ is less than 0.5, i.e., when the sound is between "direct point source" and "three-loudspeakers coherent sound", the target covariance matrix determiner 1205 can be configured to determine the direct part covariance matrix to be $$C_D=rE((1-2\zeta)C_{VBAP}+2\zeta C_{LRC}).$$

When the spread coherence parameter $\zeta$ is between 0.5 and 1, i.e., when the sound is between "three-loudspeakers coherent sound" and "two spread loudspeakers coherent sound", the target covariance matrix determiner 1205 can determine a spread distribution vector.

$$v_{DISTR,3} = \begin{bmatrix} (2-2\zeta) \\ 1 \\ 1 \end{bmatrix} \frac{1}{\sqrt{(2-2\zeta)^2+2}}.$$

Then the target covariance matrix determiner 1205 can be configured to determine a panning vector $v_{DISTR}$ where the $i_c$th entry is the first entry of $v_{DISTR,3}$, and $i_l$th and $i_r$th entries are the second and third entries of $v_{DISTR,3}$. The direct part covariance matrix may then be calculated by the target covariance matrix determiner 1205 to be, $$C_D = rE(v_{DISTR} v_{DISTR}^H).$$

The target covariance matrix determiner 1205 may then obtain the target covariance matrix $C_T = C_D + C_A$ to process the sound. As expressed above, the ambience part covariance matrix thus accounts for the ambience energy and the spatial coherence contained by the surrounding coherence parameter γ, and the direct covariance matrix accounts for the directional energy, the direction parameter, and the spread coherence parameter ζ.

The target covariance matrix determiner 1205 may be configured to determine a target covariance matrix 1208 for a binaural output by being configured to synthesize inter-aural properties instead of inter-channel properties of surround sound.

Thus the target covariance matrix determiner 1205 may be configured to determine, the ambience covariance matrix $C_A$ for the binaural sound. The amount of ambient or non-directional energy is (1−r)E, where E is the total energy as determined previously. The ambience part covariance matrix can be determined as $$C_A(k, n) = (1 - r(k, n))E(k, n)\begin{bmatrix} 1 & c(k, n) \\ c(k, n) & 1 \end{bmatrix},$$

where $$c(k, n) = \gamma(k, n) + (1 - \gamma(k, n))c_{bin}(k),$$

and where $c_{bin}(k)$ is the binaural diffuse field coherence for the frequency of kth frequency index. In other words, when γ(k, n) is one, then the ambience covariance matrix $C_A$ is such that determines full coherence between the left and right ears. When γ(k, n) is zero, then $C_A$ is such that determines the coherence between left and right ears that is natural for a human listener in a diffuse field (roughly: zero at high frequencies, high at low frequencies).

Then the target covariance matrix determiner 1205 may be configured to determine the direct part covariance matrix $C_D$. The amount of directional energy is rE. It is possible to use similar methods to synthesize the spread coherence parameter ζ as in the loudspeaker reproduction, detailed below.

First the target covariance matrix determiner 1205 may be configured to determine a 2×1 HRTF-vector $v_{HRTF}(k, \theta(k, n), \varphi(k, n))$, where θ(k, n) is the estimated azimuth and φ(k, n) is the estimated elevation. The target covariance matrix determiner 1205 can determine a panning HRTF vector that is equivalent to reproducing sound coherently at three directions $$v_{LRC_HRTF}(k, \theta(k, n), \varphi(k, n)) = \frac{v_{HRTF}(k, \theta(k, n), \varphi(k, n)) + v_{HRTF}(k, \theta(k, n) + \theta_\Delta, \varphi(k, n)) + v_{HRTF}(k, \theta(k, n) - \theta_\Delta, \varphi(k, n))}{\sqrt{3}},$$

where the $\theta_\Delta$ parameter defines the width of the "spread" sound energy with respect to the azimuth dimension. It could be, for example, 30 degrees, or half of the spread extent parameter if it is provided as a parameter input.

When the spread coherence parameter ζ is less than 0.5, i.e., when the sound is between "direct point source" and "three-loudspeakers coherent sound" the target covariance matrix determiner 1205 can be configured to determine the direct part HRTF covariance matrix to be, $$C_D = rE((1-2\zeta)v_{HRTF} v_{HRTF}^2 + 2\zeta v_{LRC_HRTF} v_{LRC_HRTF}^H).$$

When the spread coherence parameter ζ is between 0.5 and 1, i.e., when the sound is between "three-loudspeakers coherent sound" and "two spread loudspeakers coherent sound", the target covariance matrix determiner 1205 can determine a spread distribution by re-utilizing the amplitude-distribution vector $v_{DISTR,3}$ (same as in the loudspeaker rendering). A combined head related transfer function (HRTF) vector can then be determined as $$v_{DISTR_HRTF}(k,\theta(k,n),\varphi(k,n)) = [v_{HRTF}(k,\theta(k,n),\varphi(k,n)) \; v_{HRTF}(k,\theta(k,n)+\theta_\Delta,\varphi(k,n)) \; v_{HRTF}(k,\theta(k,n)-\theta_\Delta,\varphi(k,n))] v_{DISTR,3}.$$

The above formula produces the weighted sum of the three HRTFs with the weights in $v_{DISTR,3}$. The direct part HRTF covariance matrix is then $$C_D = rE(v_{DISTR_HRTF} v_{DISTR_HRTF}^H).$$

Then, the target covariance matrix determiner 1205 is configured to obtain the target covariance matrix $C_T = C_D + C_A$ to process the sound. As expressed above, the ambience part covariance matrix thus accounts for the ambience energy and the spatial coherence contained by the surrounding coherence parameter γ, and the direct covariance matrix accounts for the directional energy, the direction parameter, and the spread coherence parameter ζ.

The target covariance matrix determiner 1205 may be configured to determine a target covariance matrix 1208 for an Ambisonic output by being configured to synthesize inter-channel properties of the Ambisonic signals instead of inter-channel properties of loudspeaker surround sound. The first-order Ambisonic (FOA) output is exemplified in the following, however, it is straightforward to extend the same principles to higher-order Ambisonic output as well.

Thus the target covariance matrix determiner 1205 may be configured to determine, the ambience covariance matrix CA for the Ambisonic sound. The amount of ambient or non-directional energy is (1−r)E, where E is the total energy as determined previously. The ambience part covariance matrix can be determined as $$C_A = (1 - r)E\left((1 - \gamma)\begin{bmatrix} 1 & 0 & 0 & 0 \\ 0 & \frac{1}{3} & 0 & 0 \\ 0 & 0 & \frac{1}{3} & 0 \\ 0 & 0 & 0 & \frac{1}{3} \end{bmatrix} + \gamma\begin{bmatrix} 1 & 0 & 0 & 0 \\ 0 & 0 & 0 & 0 \\ 0 & 0 & 0 & 0 \\ 0 & 0 & 0 & 0 \end{bmatrix}\right),$$

In other words, when γ(k, n) is one, then the ambience covariance matrix $C_A$ is such that only the $0^{th}$ order component receives a signal. The meaning of such an Ambisonic signal is reproduction of the sound spatially coherently. When γ(k, n) is zero, then $C_A$ corresponds to an Ambisonic covariance matrix in a diffuse field. The normalization of the $0^{th}$ and $1^{st}$ order elements above is according to the known SN3D normalization scheme.

Then the target covariance matrix determiner 1205 may be configured to determine the direct part covariance matrix $C_D$. The amount of directional energy is rE. It is possible to use similar methods to synthesize the spread coherence parameter $\zeta$ as in the loudspeaker reproduction, detailed below.

First the target covariance matrix determiner 1205 may be configured to determine a 4×1 Ambisonic panning vector $v_{Amb}(\theta(k, n), \varphi(k, n))$, where $\theta(k, n)$ is the estimated azimuth parameter and $\varphi(k, n)$ is the estimated elevation parameter. The Ambisonic panning vector $v_{Amb}(\theta(k, n), \varphi(k, n))$ contains the Ambisonic gains corresponding to direction $\theta(k, n)$, $\varphi(k, n)$. For FOA output using the known ACN channel ordering scheme the Ambisonic panning vector is $$v_{Amb}(\theta(k, n), \varphi(k, n)) = \begin{bmatrix} 1 \\ \sin(\theta(k, n))\cos(\varphi(k, n)) \\ \sin(\varphi(k, n)) \\ \cos(\theta(k, n))\cos(\varphi(k, n)) \end{bmatrix}.$$

The target covariance matrix determiner 1205 can determine a panning Ambisonic vector that is equivalent to reproducing sound coherently at three directions $$v_{LRC_Amb}(\theta(k, n), \varphi(k, n)) = v_{Amb}(\theta(k, n), \varphi(k, n)) + \frac{v_{Amb}(\theta(k, n) + \theta_\Delta, \varphi(k, n)) + v_{Amb}(\theta(k, n) - \theta_\Delta, \varphi(k, n))}{\sqrt{3}},$$

where the $\theta_\Delta$ parameter defines the width of the "spread" sound energy with respect to the azimuth dimension. It could be, for example, 30 degrees, or half of the spread extent parameter if it is provided as a parameter input.

When the spread coherence parameter $\zeta$ is less than 0.5, i.e., when the sound is between "direct point source" and "three-loudspeakers coherent sound" the target covariance matrix determiner 1205 can be configured to determine the direct part Ambisonic covariance matrix to be, $$C_D = rE((1-2\zeta)v_{Amb}v_{Amb}^H + 2\zeta v_{LRC_Amb}v_{LRC_Amb}^H).$$

When the spread coherence parameter $\zeta$ is between 0.5 and 1, i.e., when the sound is between "three-loudspeakers coherent sound" and "two spread loudspeakers coherent sound", the target covariance matrix determiner 1205 can determine a spread distribution by re-utilizing the amplitude-distribution vector $v_{DISTR,3}$ (same as in the loudspeaker rendering). A combined Ambisonic panning vector can then be determined as $$v_{DISTR_Amb}(\theta(k,n),\varphi(k,n)) = [v_{Amb}(\theta(k,n),\varphi(k,n)) v_{Amb}(\theta(k,n)+\theta_\Delta,\varphi(k,n)) v_{Amb}(\theta(k,n)-\theta_\Delta,\varphi(k,n))] v_{DISTR,3}.$$

The above formula produces the weighted sum of the three Ambisonic panning vectors with the weights in $v_{DISTR,3}$. The direct part Ambisonic covariance matrix is then $$C_D = rE(v_{DISTR_Amb}v_{DISTR_Amb}^H).$$

Then, the target covariance matrix determiner 1205 is configured to obtain the target covariance matrix $C_T = C_D + C_A$ to process the sound. As expressed above, the ambience part covariance matrix thus accounts for the ambience energy and the spatial coherence contained by the surrounding coherence parameter $\gamma$, and the direct covariance matrix accounts for the directional energy, the direction parameter, and the spread coherence parameter $\zeta$.

In other words, the same general principles apply in constructing the binaural or Ambisonic or loudspeaker target covariance matrix. The main difference is to utilize HRTF data or Ambisonic panning data instead of loudspeaker amplitude panning data in the rendering of the direct part, and to utilize binaural coherence (or specific Ambisonic ambience covariance matrix handling) instead of inter-channel (zero) coherence in rendering the ambient part. It would be understood that a processor may be able to run software implementing the above and thus be able to render each of these output types.

In the above formulas the energies of the direct and ambient parts of the target covariance matrices were weighted based on a total energy estimate E from the estimated input covariance matrix. Optionally, such weighting can be omitted, i.e., the direct part energy is determined as r, and the ambience part energy as (1−r). In that case, the estimated input covariance matrix is instead normalized with the total energy estimate, i.e., multiplied with 1/E. The resulting mixing matrix based on such determined target covariance matrix and normalized input covariance matrix may exactly or practically be the same than with the formulation provided previously, since the relative energies of these matrices matter, not their absolute energies.

In the above formulas the spread coherent sound was determined to be reproduced at the same plane left and right to the direction according to the direction parameter. In another embodiment the coherent sound is reproduced using loudspeaker rings and areas around the direction parameter. In that embodiment, for example in the case of loudspeaker reproduction, a spread coherent sound corresponding to $\zeta=1$ would be reproduced using a ring of loudspeakers determined by being within tolerance by an angle $\alpha$ apart from the center loudspeaker $l_c$. In another example a spread coherent sound corresponding to $\zeta=0.5$ would be reproduced using a virtual surface of loudspeakers determined by being within angle $\alpha$ from the center loudspeaker $l_c$. The angle $\alpha$ could be determined to be half of the spread extent parameter if it is provided as a parameter input, or a constant, for example 30 degrees.

Figure 12:
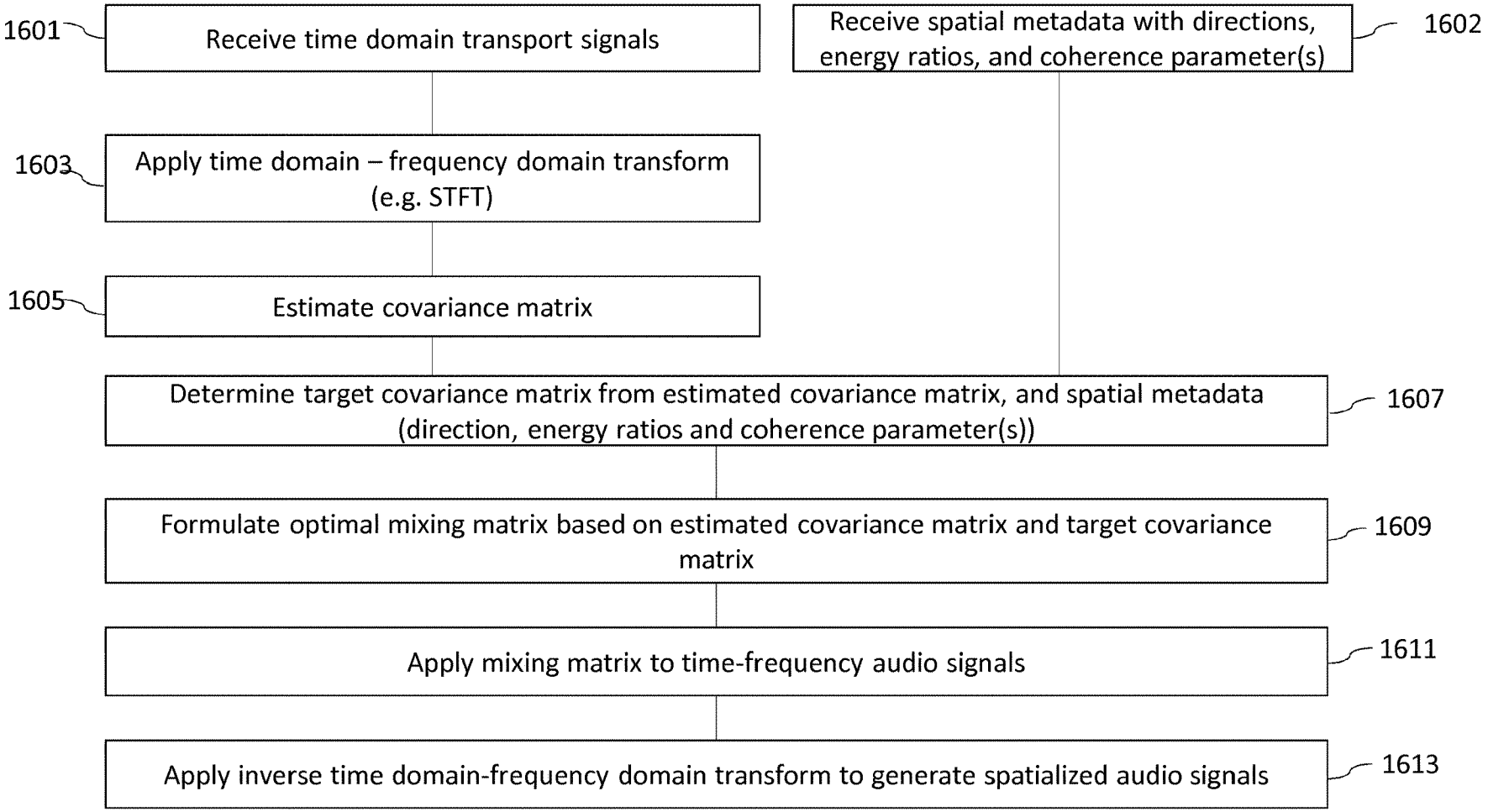
FIG. 12 shows a flow diagram of an example operation of the synthesis processor as shown in FIG. 11 according to some embodiments.

With respect to FIG. 12 an overview of the synthesis operations is shown.

The method thus may receive the time domain transport signals as shown in FIG. 12 by step 1601.

These transport signals may then be time to frequency domain transformed as shown in FIG. 12 by step 1603.

The covariance matrix may then be estimated from the input (transport audio) signals as shown in FIG. 12 by step 1605.

Furthermore the spatial metadata with directions, energy ratios and coherence parameters may be received as shown in FIG. 12 by step 1602.

The target covariance matrix may be determined from the estimated covariance matrix, directions, energy ratios and coherence parameter(s) as shown in FIG. 12 by step 1607.

The optimal mixing matrix may then be determined based on estimated covariance matrix and target covariance matrix as shown in FIG. 12 by step 1609.

The mixing matrix may then be applied to the time-frequency downmix signals as shown in FIG. 12 by step 1611.

The result of the application of the mixing matrix to the time-frequency downmix signals may then be inverse time to frequency domain transformed to generate the spatialized audio signals as shown in FIG. 12 by step 1613.

Figure 13:
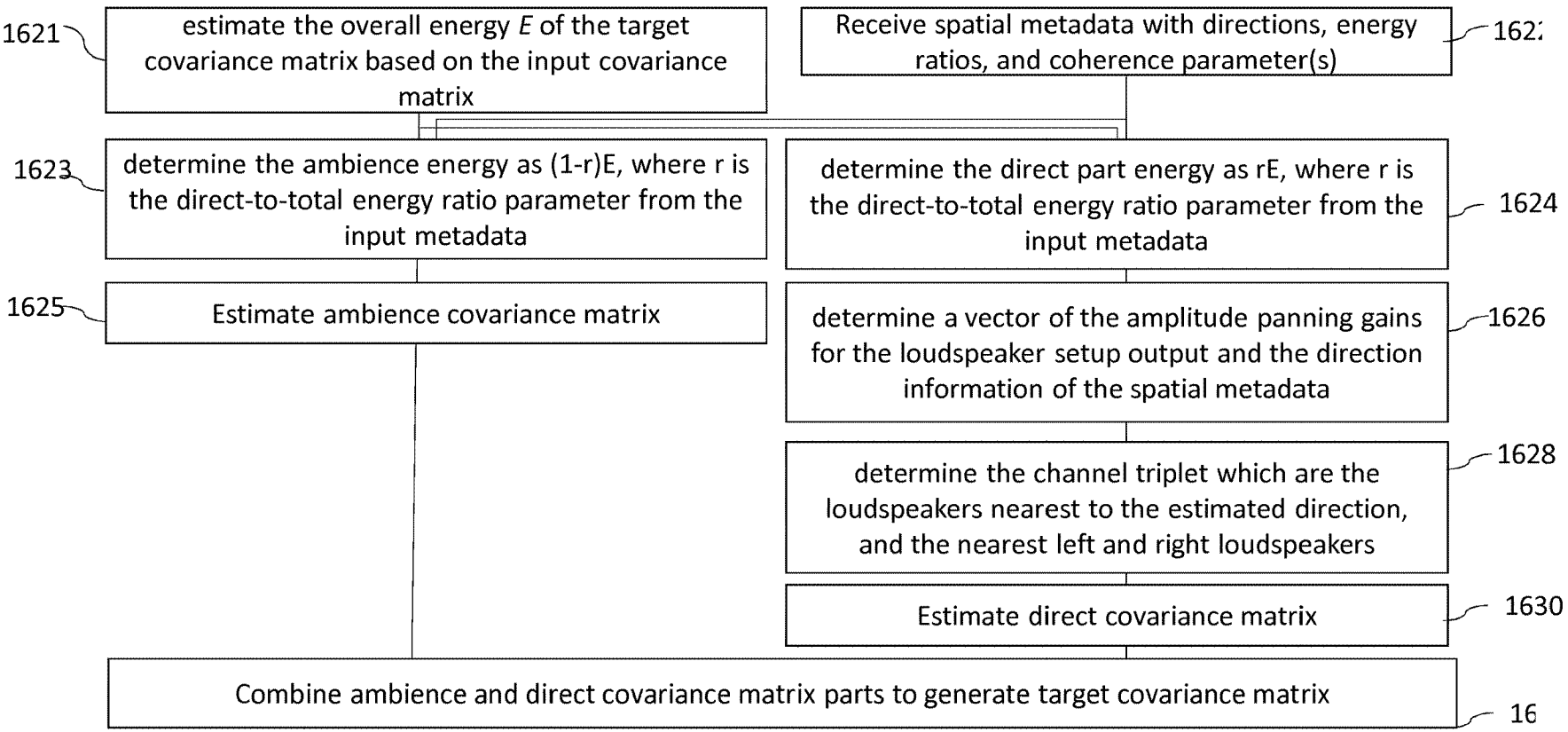
FIG. 13 shows a flow diagram of an example operation of a generation of a target covariance matrix according to some embodiments.

With respect to FIG. 13 an example method for generating the target covariance matrix according to some embodiments is shown.

First is to estimate the overall energy E of the target covariance matrix based on the input covariance matrix as shown in FIG. 13 by step 1621.

Then the method may comprise determining the ambience energy as (1−r)E, where r is the direct-to-total energy ratio parameter from the input metadata as shown in FIG. 13 by step 1623.

Furthermore the method may comprise estimating the ambience covariance matrix as shown in FIG. 13 by step 1625.

Also the method may comprise determining the direct part energy as rE, where r is the direct-to-total energy ratio parameter from the input metadata as shown in FIG. 13 by step 1624.

The method may then comprise determining a vector of the amplitude panning gains for the loudspeaker setup and the direction information of the spatial metadata as shown in FIG. 13 by step 1626.

Following this the method may comprise determining the channel triplet which are the loudspeakers nearest to the estimated direction, and the nearest left and right loudspeakers as shown in FIG. 13 by step 1628.

Then the method may comprise estimating the direct covariance matrix as shown in FIG. 13 by step 1630.

Finally the method may comprise combining the ambience and direct covariance matrix parts to generate target covariance matrix as shown in FIG. 13 by step 1631.

The above formulation discusses the construction of the target covariance matrix. The method in US20140233762A1 and the related journal publication has also further details, most relevantly, the determination and usage of a prototype matrix. The prototype matrix determines a "reference signal" for the rendering with respect to which the least-squares optimized mixing solution is formulated. In case a stereo downmix is provided as the audio signal in the codec, a prototype matrix for loudspeaker rendering can be such that determines that the signals for the left-hand side loudspeakers are optimized with respect to the provided left channel of the stereo track, and similarly for the right-hand side (centre channel could be optimized with respect to the sum of the left and right audio channels). For binaural output, the prototype matrix could be such that determines that the reference signal for the left ear output signal is the left stereo channel, and similarly for the right ear. The determination of a prototype matrix is straightforward for an engineer skilled in the field having studied the prior literature. With respect to the prior literature, the novel aspect in the present formulation at the synthesis stage is the construction of the target covariance matrix utilizing also the spatial coherence metadata.

Although not repeated throughout the document, it is to be understood that spatial audio processing, both typically and in this context, takes place in frequency bands. Those bands could be for example, the frequency bins of the time-frequency transform, or frequency bands combining several bins. The combination could be such that approximates properties of human hearing, such as the Bark frequency resolution. In other words, in some cases, we could measure and process the audio in time-frequency areas combining several of the frequency bins b and/or time indices n. For simplicity, these aspects were not expressed by all of the equations above. In case many time-frequency samples are combined, typically one set of parameters such as one direction is estimated for that time-frequency area, and all time-frequency samples within that area are synthesized according to that set of parameters, such as that one direction parameter.

The usage of a frequency resolution for parameter analysis that is different than the frequency resolution of the applied filter-bank is a typical approach in the spatial audio processing systems.

The proposed method can thus detect or identify where the following common multi-channel mixing techniques have been applied to loudspeaker signals:

1) The sound is reproduced coherently using two loudspeakers for creating an "airy" perception (e.g., use front left and right instead of centre).
2) The sound is reproduced coherently using three (or more) loudspeakers for creating a "close" perception (e.g., use front left, right and centre instead of only centre)
3) The sound is reproduced coherently from all (or nearly all) loudspeakers for creating an "inside-the-head" or "above" perception This detection or identification information may in some embodiments be passed from the encoder to the decoder by using a number of (time-frequency domain) parameters. Two of these are the spread coherence and surrounding coherence parameters. In addition, the energy ratio parameter may be modified to improve audio quality having determined such situations as described above.

In the synthesis stage, the state-of-the-art methods (which do not use the proposed novel parameters) have the following issues with these situations, respectively:

1) Sound is reproduced largely as ambient: Dry sound in the centre loudspeaker, and decorrelated sound in all loudspeakers. This results in an ambient-like perception, whereas the perception was "airy" with the original signals.
2) Sound is reproduced partially as ambient: Dry sound in the centre loudspeaker, and decorrelated sound in all loudspeakers. The sound source is perceived to be far away, whereas it was close with original signals.
3) The sound is reproduced as ambient: almost all sound is reproduced as decorrelated from all loudspeakers. The spatial perception is almost the opposite to that of the original signals.

However in the synthesis stages which implement the embodiments described herein, the synthesis can reproduce these cases without issues (using the proposed novel parameters), respectively:

1) The sound is reproduced coherently using two loudspeakers as in the original signals.
2) The sound is reproduced coherently using three loudspeakers as in the original signals.
3) The sound is reproduced coherently using all loudspeakers as in the original signals.

In some embodiments to accommodate for the above analysis embodiments, the synthesis may further use the full set of output channels. In such embodiments instead of using just three channels, all channels inside spread extent are used to reproduce coherent signals and to extend the formulation to a multiple speaker case. Similarly in some embodiments the closest loudspeaker around the edge of the spread extent is selected to be the actual edge. However a circle zone is created to act as the two clear loudspeakers as the edge as defined in the synthesis method above. As speaker nodes or loudspeakers may not be exactly on this circle in all directions in some embodiments a tolerance zone is defined (e.g. 10 degrees) that allows also loudspeakers to be slightly outside of the spread extent to be included thus producing a more probable best circular edge.

Figure 14:
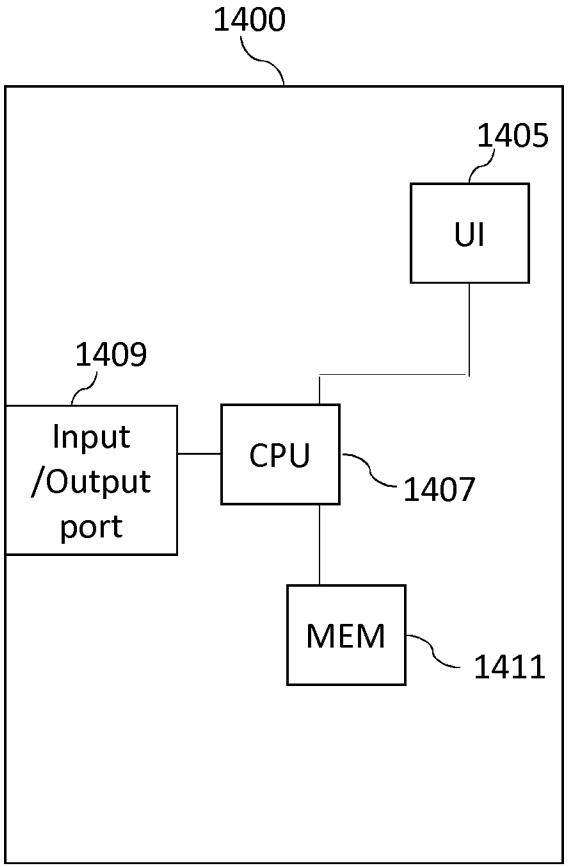
FIG. 14 shows schematically an example device suitable for implementing the apparatus described herein.

With respect to FIG. 14 an example electronic device which may be used as the analysis or synthesis device is shown. The device may be any suitable electronics device or apparatus. For example in some embodiments the device 1400 is a mobile device, user equipment, tablet computer, computer, audio playback apparatus, etc.

In some embodiments the device 1400 comprises at least one processor or central processing unit 1407. The processor 1407 can be configured to execute various program codes such as the methods such as described herein.

In some embodiments the device 1400 comprises a memory 1411. In some embodiments the at least one processor 1407 is coupled to the memory 1411. The memory 1411 can be any suitable storage means. In some embodiments the memory 1411 comprises a program code section for storing program codes implementable upon the processor 1407. Furthermore in some embodiments the memory 1411 can further comprise a stored data section for storing data, for example data that has been processed or to be processed in accordance with the embodiments as described herein. The implemented program code stored within the program code section and the data stored within the stored data section can be retrieved by the processor 1407 whenever needed via the memory-processor coupling.

In some embodiments the device 1400 comprises a user interface 1405. The user interface 1405 can be coupled in some embodiments to the processor 1407. In some embodiments the processor 1407 can control the operation of the user interface 1405 and receive inputs from the user interface 1405. In some embodiments the user interface 1405 can enable a user to input commands to the device 1400, for example via a keypad. In some embodiments the user interface 1405 can enable the user to obtain information from the device 1400. For example the user interface 1405 may comprise a display configured to display information from the device 1400 to the user. The user interface 1405 can in some embodiments comprise a touch screen or touch interface capable of both enabling information to be entered to the device 1400 and further displaying information to the user of the device 1400. In some embodiments the user interface 1405 may be the user interface for communicating with the position determiner as described herein.

In some embodiments the device 1400 comprises an input/output port 1409. The input/output port 1409 in some embodiments comprises a transceiver. The transceiver in such embodiments can be coupled to the processor 1407 and configured to enable a communication with other apparatus or electronic devices, for example via a wireless communications network. The transceiver or any suitable transceiver or transmitter and/or receiver means can in some embodiments be configured to communicate with other electronic devices or apparatus via a wire or wired coupling.

The transceiver can communicate with further apparatus by any suitable known communications protocol. For example in some embodiments the transceiver or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

The transceiver input/output port 1409 may be configured to receive the loudspeaker signals and in some embodiments determine the parameters as described herein by using the processor 1407 executing suitable code. Furthermore the device may generate a suitable downmix signal and parameter output to be transmitted to the synthesis device.

In some embodiments the device 1400 may be employed as at least part of the synthesis device. As such the input/output port 1409 may be configured to receive the downmix signals and in some embodiments the parameters determined at the capture device or processing device as described herein, and generate a suitable audio signal format output by using the processor 1407 executing suitable code. The input/output port 1409 may be coupled to any suitable audio output for example to a multichannel speaker system and/or headphones or similar.

As used in this application, the term "circuitry" may refer to one or more or all of the following:

(a) hardware-only circuit implementations (such as implementations in only analogue and/or digital circuitry) and (b) combinations of hardware circuits and software, such as (as applicable):

(i) a combination of analogue and/or digital hardware circuit(s) with software/firmware and (ii) any portions of hardware processor(s) with software (including digital signal processor(s)), software, and memory(ies) that work together to cause an apparatus, such as a mobile phone or server, to perform various functions) and (c) hardware circuit(s) and or processor(s), such as a microprocessor(s) or a portion of a microprocessor(s), that requires software (e.g., firmware) for operation, but the software may not be present when it is not needed for operation. This definition of circuitry applies to all uses of this term in this application, including in any claims. As a further example, as used in this application, the term circuitry also covers an implementation of merely a hardware circuit or processor (or multiple processors) or portion of a hardware circuit or processor and its (or their) accompanying software and/or firmware. The term circuitry also covers, for example and if applicable to the particular claim element, a baseband integrated circuit or processor integrated circuit for a mobile device or a similar integrated circuit in server, a cellular network device, or other computing or network device.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. Apparatus comprising at least one processor; and at least one non-transitory memory including a computer program code, the at least one memory and the computer program code configured to, with the at least one processor, cause the apparatus at least to:

determine, for two or more speaker channel audio signals, at least one spatial audio parameter for providing spatial audio reproduction;

determine between the two or more speaker channel audio signals at least one audio signal relationship parameter, the at least one audio signal relationship parameter being associated with at least one coherence parameter, in such a way that the at least one coherence parameter provides at least one inter-channel coherence information between the two or more speaker channel audio signals for at least two frequency bands, wherein the at least one inter-channel coherence information is configured to enable reproduction of the two or more speaker channel audio signals based on the at least one spatial audio parameter and the at least one audio signal relationship parameter; and transmit the at least one spatial audio parameter and at least one determined value, wherein the at least one determined value is configured to indicate at least one information associated with the at least one inter-channel coherence information.

2. The apparatus as claimed in claim 1, wherein the apparatus is configured to transmit the at least one determined value, and wherein the at least one memory and the computer program code are configured to, with the at least one processor, further cause the apparatus to transmit at least one of:

at least one orientation of the at least one coherence parameter;

at least one width of the at least one coherence parameter; or at least one extent of the at least one coherence parameter.

3. The apparatus as claimed in claim 2, wherein the at least one determined value comprises at least one of:

at least one orientation code;

at least one width code; or at least one extent code.

4. The apparatus as claimed in claim 1, wherein the at least one memory and the computer program code are configured to, with the at least one processor, cause the apparatus to determine, from the two or more speaker channel audio signals, at least one of:

at least one direction parameter and/or at least one energy ratio; or a transport audio signal, wherein the two or more speaker channel audio signals are configured to be reproduced based on the at least one spatial audio parameter, the at least one coherence parameter and/or the transport audio signal.

5. The apparatus as claimed in claim 1, wherein the apparatus is configured to determine, between the two or more speaker channel audio signals, the at least one coherence parameter, comprising the at least one memory and the computer program code are configured to, with the at least one processor, cause the apparatus to determine a spread coherence parameter, wherein the spread coherence parameter is determined based on an inter-channel coherence information between two or more speaker channel audio signals spatially adjacent to an identified speaker channel audio signal, the identified speaker channel audio signal being identified based on the at least one spatial audio parameter.

6. The apparatus as claimed in claim 4, wherein the at least one memory and the computer program code are configured to, with the at least one processor, cause the apparatus to determine a spread coherence parameter, comprising the at least one memory and the computer program code are configured to, with the at least one processor, further cause the apparatus to:

determine a stereoness parameter indicating that the two or more speaker channel audio signals are reproduced coherently using two speaker channel audio signals spatially adjacent to an identified speaker channel audio signal, the identified speaker channel audio signal being a speaker channel audio signal spatially closest to the at least one direction parameter;

determine a coherent panning parameter indicating that the two or more speaker channel audio signals are reproduced coherently using at least the two speaker channel audio signals spatially adjacent to the identified speaker channel audio signal; and generate the spread coherence parameter based on the stereoness parameter and the coherent panning parameter.

7. The apparatus as claimed in claim 6, wherein the apparatus configured to generate the spread coherence parameter based on the stereoness parameter and the coherent panning parameter comprises the at least one memory and the computer program code are configured to, with the at least one processor, further cause the apparatus to:

determine a main direction analysis to identify a speaker nearest to the at least one direction parameter;

search from the identified speaker, comprising searching a search area, comprising an angle from 0 to 180 degrees, in a series of angle steps;

estimate average coherence values between a defined main speaker channel and any speaker channels within the search area, wherein the speaker is associated with the defined main speaker channel, wherein respective speakers are associated with the any speaker channels;

determine a substantially constant coherence area based on the average coherence values;

set a spread extent at two times a largest coherence area of the substantially constant coherence area; and define the coherence panning parameter based on the spread extent.

8. The apparatus as claimed in claim 7, wherein the apparatus configured to define the coherence panning parameter based on the largest coherence area comprises the at least one memory and the computer program code are configured to, with the at least one processor, further cause the apparatus to:

determine the speaker closest to the at least one direction parameter;

determine a normalized coherence between the speaker and any speakers inside the largest coherence area;

omit speakers with energy below a threshold energy;

select a minimum coherence from remaining speakers;

determine an energy distribution parameter based on an energy distribution among the remaining speakers; and multiply the energy distribution parameter with the largest coherence area to determine the coherence panning parameter.

9. The apparatus as claimed in claim 6, wherein the apparatus configured to determine the stereoness parameter comprises the at least one memory and the computer program code are configured to, with the at least one processor, cause the apparatus to:

determine a main direction analysis to identify a speaker nearest to the at least one direction parameter;

search from a direction from the identified speaker, comprising searching a search area, defined by an angle from 0 to 180 degrees, in a series of angle steps;

estimate average coherence values and average energy values for any speaker located near to the search area;

determine a largest coherence angle of the search area based on the average coherence values and the average energy values;

set a spread extent at two times the largest coherence angle; and define the stereoness parameter based on the spread extent.

10. The apparatus as claimed in claim 9, wherein the apparatus configured to define the stereoness parameter based on the spread extent comprises the at least one memory and the computer program code are configured to, with the at least one processor, cause the apparatus to:

identify a speaker on the largest coherence angle that has the most energy;

determine normalized coherences between the identified speaker and other speakers on the largest coherence angle;

determine a mean of the normalised coherences weighted with respective energies;

determine a ratio of energies on the largest coherence angle and inside the largest coherence angle; and multiply the ratio of energies and the mean of normalised coherences to form the stereoness parameter.

11. A method comprising:

determining, for two or more speaker channel audio signals, at least one spatial audio parameter for providing spatial audio reproduction;

determining between the two or more speaker channel audio signals at least one audio signal relationship parameter, the at least one audio signal relationship parameter being associated with at least one coherence parameter, in such a way that the at least one coherence parameter provides at least one inter-channel coherence information between the two or more speaker channel audio signals for at least two frequency bands, wherein the at least one inter-channel coherence information is configured to enable reproduction of the two or more speaker channel audio signals based on the at least one spatial audio parameter and the at least one audio signal relationship parameter; and transmitting the at least one spatial audio parameter and at least one determined value, wherein the at least one determined value is configured to indicate at least one information associated with the at least one inter-channel coherence information.

12. The method as claimed in claim 11, wherein the transmitting of the at least one information associated with the at least one inter-channel coherence comprises transmitting at least one of:

at least one orientation of the at least one coherence parameter;

at least one width of the at least one coherence parameter; or at least one extent of the at least one coherence parameter.

13. The method as claimed in claim 11, wherein the determining of the at least one spatial audio parameter comprises determining, for the two or more speaker channel audio signals, at least one of:

at least one direction parameter and/or at least one energy ratio; or a transport audio signal, wherein the two or more speaker channel audio signals are configured to be reproduced based on the at least one spatial audio parameter, the at least one coherence parameter and/or the transport audio signal.

14. The method as claimed in claim 11, wherein the determining between the two or more speaker channel audio signals of the at least one coherence parameter comprises determining a spread coherence parameter, wherein the spread coherence parameter is determined based on an inter-channel coherence information between two or more speaker channel audio signals spatially adjacent to an identified speaker channel audio signal, the identified speaker channel audio signal being identified based on the at least one spatial audio parameter.

15. The method as claimed in claim 13, further comprising determining a spread coherence parameter, comprising:

determining a stereoness parameter indicating that the two or more speaker channel audio signals are reproduced coherently using two speaker channel audio signals spatially adjacent to the identified speaker channel audio signal, the identified speaker channel audio signal being a speaker channel audio signal spatially closest to the at least one direction parameter;

determining a coherent panning parameter indicating that the two or more speaker channel audio signals are reproduced coherently using at least the two speaker channel audio signals spatially adjacent to the identified speaker channel audio signal; and generating the spread coherence parameter based on the stereoness parameter and the coherent panning parameter.

16. The method as claimed in claim 15, wherein the generating of the spread coherence parameter further comprises:

determining a main direction analysis to identify a speaker nearest the at least one direction parameter;

searching from a direction from the identified speaker, comprising searching a search area, comprising an angle from 0 to 180 degrees, in a series of angle steps;

estimating average coherence values between a defined main speaker channel and any speaker channels within the search area, wherein the speaker is associated with the defined main speaker channel, wherein respective speakers are associated with the any speaker channels;

determining a substantially constant coherence area based on the average coherence values;

setting a spread extent at two times a largest coherence area of the substantially constant coherence area; and defining the coherence panning parameter based on the spread extent.

17. The method as claimed in claim 12, wherein the at least one determined value comprises at least one of:

at least one orientation code;

at least one width code; or at least one extent code.

18. The method as claimed in claim 16, wherein the defining of the coherence panning parameter based on the largest coherence area further comprises:

determining the speaker closest to the at least one direction parameter;

determining a normalized coherence between the speaker and any speakers inside the largest coherence area;

omitting speakers with energy below a threshold energy;

selecting a minimum coherence from remaining speakers;

determining an energy distribution parameter based on an energy distribution among the remaining speakers; and multiplying the energy distribution parameter with the largest coherence area to determine the coherence panning parameter.

19. The method as claimed in claim 15, wherein the determining of the stereoness parameter comprises:

determining a main direction analysis to identify a speaker nearest to the at least one direction parameter;

searching from a direction from the identified speaker, comprising searching a search area, defined with an angle from 0 to 180 degrees, in a series of angle steps;

estimating average coherence values and average energy values for any speaker located near to the search area;

determining a largest coherence angle of the search area based on the average coherence values and the average energy values;

setting a spread extent at two times the largest coherence angle; and defining the stereoness parameter based on the spread extent.

20. The method as claimed in claim 19, wherein the defining of the stereoness parameter based on the spread extent comprises:

identifying a speaker on the largest coherence angle that has the most energy;

determining normalized coherences between the identified speaker and other speakers on the largest coherence angle;

determining a mean of the normalised coherences weighted with respective energies;

determining a ratio of energies on the largest coherence angle and inside the largest coherence angle; and multiplying the ratio of energies and the mean of normalised coherences to form the stereoness parameter.

* * * * *